US011835038B2

(12) United States Patent
Carideo et al.

(10) Patent No.: US 11,835,038 B2
(45) **Date of Patent: *Dec. 5, 2023**

(54) INTEGRATED PUMP GUARD AND CONTROL INTERLOCK

(71) Applicant: Graco Minnesota Inc., Minneapolis, MN (US)

(72) Inventors: Max Carideo, Plymouth, MN (US); James M. Dalton, Maple Grove, MN (US); Justin G Johnston, Rogers, MN (US); Steve J. Wrobel, Rogers, MN (US); Christopher A. Lins, Waverly, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/181,728

(22) Filed: Mar. 10, 2023

(65) Prior Publication Data

US 2023/0213029 A1 Jul. 6, 2023

Related U.S. Application Data

(63) Continuation of application No. 17/660,289, filed on Apr. 22, 2022, now Pat. No. 11,603,835, which is a (Continued)

(51) Int. Cl.
*F04B 17/03* (2006.01)
*F04B 53/16* (2006.01)
(Continued)

(52) U.S. Cl.
CPC ..... *F04B 49/022* (2013.01); *B05B 9/007* (2013.01); *B05B 9/0413* (2013.01); *B05B 15/52* (2018.02);
(Continued)

(58) Field of Classification Search
CPC ..... F04B 49/16; F04B 25/005; F04B 9/08; F04B 9/10; F04B 9/107; F04B 9/109;
(Continued)

(56) References Cited

U.S. PATENT DOCUMENTS 1,643,798 A 9/1927 Baxter
1,652,795 A 12/1927 Platt
(Continued)

FOREIGN PATENT DOCUMENTS

CN 1377440 A 10/2002
CN 102202802 A 9/2011
(Continued)

OTHER PUBLICATIONS

First Chinese Office Action for CN Application No. 202210132791.8, dated Apr. 15, 2023, pp. 18.
(Continued)

*Primary Examiner* — Kenneth J Hansen
*Assistant Examiner* — David N Brandt
(74) *Attorney, Agent, or Firm* — Kinney & Lange, P. A.

(57) ABSTRACT

A paint sprayer includes an end bell, a motor connected to the end bell, a pump drive connected to the end bell, a pair of protrusions attached to an extending from the end bell such that each protrusion is cantilevered from the end bell, and a pump assembly comprising a pair of mounting holes and containing a piston. The pair of mounting holes is adapted to receive and slide onto the pair of protrusions to mount the pump assembly on the end bell as well as slide off of the pair of protrusions to remove the pump assembly from the end bell. The pump drive is configured to covert rotational motion output by the motor to reciprocal motion. The pump assembly is configured to pump paint when reciprocated by the pump drive while mounted on the end bell.

18 Claims, 13 Drawing Sheets

Related U.S. Application Data continuation of application No. 16/828,195, filed on Mar. 24, 2020, now Pat. No. 11,319,947, which is a continuation of application No. 15/403,858, filed on Jan. 11, 2017, now Pat. No. 10,634,132.

(60) Provisional application No. 62/277,813, filed on Jan. 12, 2016.

(51) Int. Cl.

| | |
|---|---|
| ***F04B 53/22*** | (2006.01) |
| ***F04B 15/02*** | (2006.01) |
| ***F04B 49/10*** | (2006.01) |
| ***F04B 49/02*** | (2006.01) |
| ***B05B 9/00*** | (2006.01) |
| ***B05B 9/04*** | (2006.01) |
| ***F04B 19/22*** | (2006.01) |
| ***B05B 15/52*** | (2018.01) |
| ***F04B 23/02*** | (2006.01) |

(52) U.S. Cl.

CPC ..... *F04B 15/02* (2013.01); *F04B 17/03* (2013.01); *F04B 19/22* (2013.01); *F04B 23/02* (2013.01); *F04B 49/10* (2013.01); *F04B 53/16* (2013.01); *F04B 53/22* (2013.01); *F04B 2203/0208* (2013.01); *F04B 2207/02* (2013.01)

(58) Field of Classification Search

CPC ..... F04B 19/22; F04B 27/005; F04B 49/002; F04B 49/08; F04B 49/22; F04B 53/10; F04B 2201/0201; F04B 2201/0206; F04B 2201/0808

See application file for complete search history.

(56) References Cited

U.S. PATENT DOCUMENTS

| | | | | |
|---|---|---|---|---|
| 2,204,002 | A | 6/1940 | Rowe | |
| 4,009,971 | A | 3/1977 | Krohn et al. | |
| 4,982,063 | A | 1/1991 | Tsunekawa et al. | |
| 5,127,555 | A | 7/1992 | Mittermaier | |
| 5,292,232 | A | 3/1994 | Krohn et al. | |
| 5,597,991 | A | 1/1997 | Chen et al. | |
| 5,725,364 | A | 3/1998 | Mirazita | |
| 6,710,270 | B2 | 3/2004 | Naimer | |
| 6,752,067 | B1 * | 6/2004 | Davidson | F04B 53/20 417/415 |
| 7,029,296 | B1 | 4/2006 | Toy et al. | |
| 7,935,888 | B2 | 5/2011 | Hansen et al. | |
| 8,651,397 | B2 * | 2/2014 | Gaddis | B05B 7/2464 239/154 |
| 9,068,567 | B2 | 6/2015 | Hitter et al. | |
| 2002/0165503 | A1 | 11/2002 | Morris et al. | |
| 2002/0168275 | A1 | 11/2002 | Cooper et al. | |
| 2008/0164129 | A1 | 7/2008 | Jones | |
| 2012/0269568 | A1 | 10/2012 | Matsubara et al. | |
| 2014/0206211 | A1 | 7/2014 | Coughlan et al. | |
| 2014/0276533 | A1 | 9/2014 | Butterfield et al. | |
| 2016/0186788 | A1 | 6/2016 | Davidson et al. | |

FOREIGN PATENT DOCUMENTS

| | | | |
|---|---|---|---|
| CN | 202683377 | U | 1/2013 |
| CN | 203067211 | U | 7/2013 |
| CN | 104005965 | A | 8/2014 |
| CN | 104870099 | A | 8/2015 |
| CN | 105080878 | A | 11/2015 |
| CN | 204783612 | U | 11/2015 |
| GB | 2538556 | A | 11/2016 |
| JP | 2010223234 | A | 10/2010 |
| JP | 2014121312 | A | 7/2014 |
| KR | 930001989 | A | 2/1993 |
| WO | 2010047800 | A2 | 4/2010 |

OTHER PUBLICATIONS

First Australian Office Action for AU Application No. 2022202098, dated Mar. 9, 2023, pp. 2.

Communication Pursuant to Article 94(3) EPC for EP Application No. 17150965.6, dated May 19, 2021, pp. 8.

Extended European Search Report for EP Application No. 17150965.6, dated Sep. 15, 2017, pp. 12.

First Chinese Office Action for CN Application No. 201710027987.X, dated Aug. 24, 2018, pp. 16.

First Chinese Office Action for CN Application No. 2019105225964, dated Sep. 3, 2020, pp. 14.

First Examination Report for AU Application No. 2017200180, dated Sep. 6, 2021, pp. 3.

Partial European Search Report for EP Application No. 17160965.6, dated Jun. 13, 2017, pp. 15.

Second Chinese Office Action for CN Application No. 2019105225964, dated May 19, 2021, pp. 10.

First Korean Office Action for KR Application 10-2017-0003971, dated Jun. 19, 2023, pp. 9.

* cited by examiner

INTEGRATED PUMP GUARD AND CONTROL INTERLOCK

CROSS-REFERENCE TO RELATED APPLICATION(S)

This application is a continuation of U.S. application Ser. No. 17/660,289 filed Apr. 22, 2022 for "INTEGRATED PUMP GUARD AND CONTROL INTERLOCK", which claims the benefit of U.S. application Ser. No. 16/828,195 filed Mar. 24, 2020 for "INTEGRATED PUMP GUARD AND CONTROL INTERLOCK", now U.S. Pat. No. 11,319,947 on May 3, 2022, which in turn claims the benefit of U.S. application Ser. No. 15/403,858 filed Jan. 11, 2017 for "INTEGRATED PUMP GUARD AND CONTROL INTERLOCK," now U.S. Pat. No. 10,634,132 on Apr. 28, 2020, which in turn claims the benefit of U.S. Provisional Application No. 62/277,813, filed Jan. 12, 2016 for "INTEGRATED PUMP GUARD AND CONTROL INTERLOCK" by M. Carideo, J. Dalton, J. Johnston, S. Wrobel, and C. Lins.

BACKGROUND

The present application relates generally to sprayers, and more particularly to features of sprayers that facilitate maintenance and cleaning of a sprayer pump assembly.

Sprayers can be used to pump paint and/or other solutions such as water, oil, and solvents, among other solutions. These sprayers include a pump drive coupled to a pump assembly and enclosed by a housing and a front cover. The pump drive converts the motion produced by a motor to pumping motion. For example, pump drives typically convert rotary motion of a motor to reciprocating motion of a pump. In conventional sprayers, the only way to gain access to the pump assembly is to remove the front cover, which cooperates with structural features of the housing to support the pump drive components. Therefore, in order to service the pump, many components not needing service, such as components of the pump drive, are removed or at least exposed in order to gain access to the pump and/or release the pump assembly from the sprayer.

Because of the aforementioned issues, a need exists for a sprayer assembly that permits the pump assembly to be readily removed without disassembling and exposing components not in need of service, such as the pump drive.

SUMMARY

A paint sprayer includes an end bell, a motor connected to the end bell, a pump drive connected to the end bell, a pair of protrusions attached to an extending from the end bell such that each protrusion is cantilevered from the end bell, and a pump assembly comprising a pair of mounting holes and containing a piston. The pair of mounting holes is adapted to receive and slide onto the pair of protrusions to mount the pump assembly on the end bell as well as slide off of the pair of protrusions to remove the pump assembly from the end bell. The pump drive is configured to covert rotational motion output by the motor to reciprocal motion of the piston. While mounted on the end bell, the pump assembly is configured to pump paint when reciprocated by the pump drive.

A paint sprayer includes a support frame with a first side and a second side, a front cover connected to the support frame, a motor located on the first side of the support frame, a pump drive located on the second side of the support frame and between the front cover and the support frame, a pump assembly holding a piston pump, a door attached to the front cover, and a mounting interface. The mounting interface includes a pair of cantilevered protrusions and a pair of mounting holes. The pump assembly is removably mounted to the support frame by reception of the pair of cantilevered protrusions within the pair of holes. The pump drive is configured to convert rotational motion output of the motor to reciprocal motion. While mounted on the support frame, the piston pump is configured to pump paint when reciprocated by the pump drive. The door blocks the pump assembly from being removed from the support frame via the mounting interface while in a closed position, and permits the pump assembly to be mounting to the support frame via engagement of the pair of cantilevered protrusions with the pair of mounting holes while the door is in an open position.

A paint sprayer includes a support frame, a motor connected to the support frame, a pump assembly removably mounted on the support frame, a front cover connected to the support frame, a pump drive mounted on the support frame and located between the front cover and the support frame, a door attached to the front cover, an electrical connector, and a pressure control located on the pump assembly. The pump drive is configured to convert rotational motion output from the motor to reciprocal motion of a piston pump contained within the pump assembly. The piston pump is configured to pump paint when reciprocated by the pump drive while mounted on the support frame. The door is configured to linearly slide in a track of the front cover between an open position and a closed position. The door slides in a first direction towards the closed position and slides in a second direction towards the open position. The door blocks the pump assembly from being removed from the support frame while in the closed position but permits the pump to be removed from the support frame while in the open position. The electrical connector is located, in separate interfacing parts, on each of the pump assembly and the door. The pressure control is configured to output a signal that is used to regulate operation of the motor. The signal is conducted through the electrical connector. Sliding of the door in the first direction completes an electrical connection that permits the signal to travel through the electrical connector. Sliding of the door in the second direction breaks the electrical connection to prevent the signal from traveling through the electrical connector.

DETAILED DESCRIPTION

Embodiments described by the present disclosure make it easy to release a pump assembly, and thereby service a pump, via a door without disassembly of the sprayer housing and/or front cover which typically encloses an open end of the housing. Leaving the structural components of the sprayer in place permits components of the pump drive (e.g., gears, cranks, an eccentric element, a yoke, and/or various other components) to remain assembled and protected by the housing and front cover of the sprayer. These and other aspects are further discussed herein.

Figure 1:
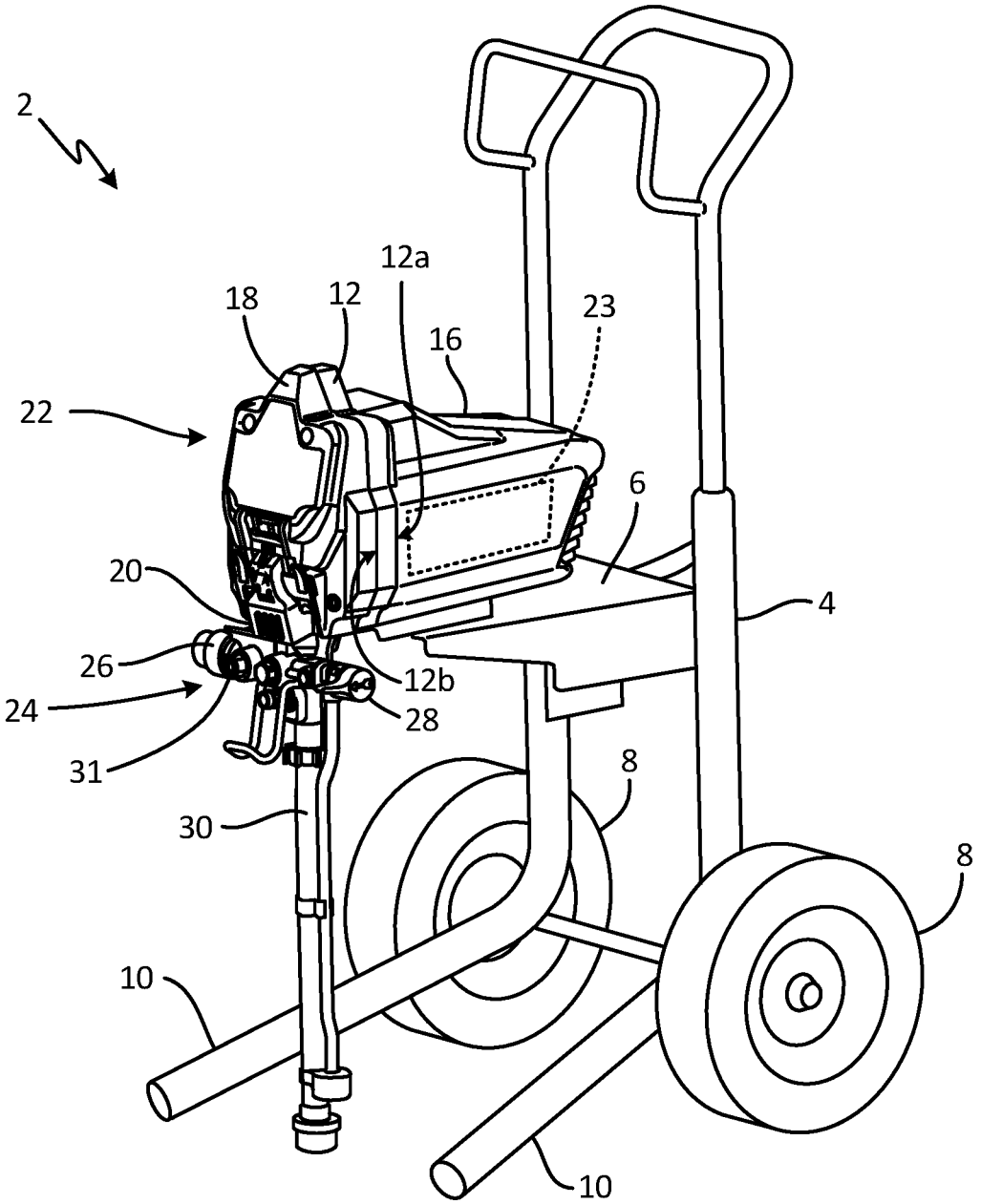
FIG. 1 is a perspective view of a sprayer used to dispense a solution through a handheld gun and hose assembly.

FIG. 1 is a perspective view of sprayer 2 used to dispense a solution, for example paint, through a handheld gun and hose assembly (not shown). Sprayer 2 is attached to frame 4 via shelf 6. Frame 4 includes wheels 8 and legs 10 to facilitate support and manual transportation of sprayer 2.

Sprayer 2 includes end bell 12, motor housing 16, front cover 18, and door 20 that together form enclosure 22 housing components of sprayer 2 such as motor 23 (shown schematically in FIG. 1) and components of the pump drive, which is described in further detail with respect to FIGS. 10 and 12A-C. End bell 12 is a structural component that supports motor housing 16 and front cover 18 in addition to providing a mounting point for sprayer 2 to shelf 6. For example, front cover 18 can be secured to end bell 12 with a plurality of screws which extend through front cover 18 and screw into end bell 12. A similar attachment method can be used to affix motor housing 16 to end bell 12 and to affix end bell 12 to frame 4 via shelf 6. End bell 12 also supports motor 23 disposed within motor housing 16 and at least partially supports the pump drive disposed on an opposite side of end bell 12 from motor 23 and arranged between front cover 18 and end bell 12.

For example, end bell 12 can be a plate having first side 12*a* and second side 12*b* that is opposite first side 12*a*. Motor 23 and motor housing 16 are disposed on and are supported from first side 12*a* of end bell 12. The pump assembly 24 and associated pump drive are supported from second side 12*b* of end bell 12. End bell 12 is connected to frame 4 via shelf 6. Alternatively, end bell 12 can be a portion of a support frame (e.g., frame 4) that is structurally fixed (i.e., restrained with respect to ground) while utilizing the features of end bell 12 described above.

Pump assembly 24 is partially or fully contained within enclosure 22, and in FIG. 1 is shown protruding from enclosure 22. Pump assembly 24 includes pressure control 26 and prime control 28, however it is noted that not all embodiments of pump assembly 22 include pressure control 26 and/or prime control 28. When pressure control 26 and prime control 28 are integrated into pump assembly 24, pressure control 26 and prime control 28 control pressure regulation and priming of the pump of sprayer 2, respectively. Pressure control 26 can be an electrically-driven control containing a sensor that is sensitive to the paint pressure generated by the pump, a user input for setting the paint pressure (e.g., a rotating knob connected to a potentiometer), or a circuit for closed loop pressure regulation based on the sensor and the setting of the user input. The circuit may control motor 23 within motor housing 16 to regulate pressure, such as by switching motor 23 on and off. Sprayer 2 further includes intake hose 30 for drawing paint out of a reservoir (not shown). The paint travels through a pump contained at least partially within pump assembly 24 and out of a hose and gun assembly (not shown) attached to outlet 31 as is known in the art.

Door 20 is moveably attached to front cover 18. Door 20 can be formed from a metal or polymer, and front cover 18 can be formed as a unitary piece of metal. As will be explained further herein, front cover 18 partially contains, covers, supports, and/or protects various components of the pump drive (e.g., gears, a crank, an eccentric element, and/or a yoke), which convert the rotational output motion of motor 23 to linear reciprocating motion that drives the pump.

In conventional sprayers, the only way to gain access to all pump components and/or remove pump assembly 24 is to remove front cover 18. However, in such conventional sprayers, front cover 18 structurally supports the pump drive components. Therefore, in order to service the pump, many components not needing service, such as the pump drive components, are removed or at least exposed in order to gain access to the pump and/or release pump assembly 24. However, embodiments of the present disclosure make it easy to release pump assembly 24 (and thereby service the pump) via door 20 without removal of front cover 18. For example, when door 20 is in an open position, pump assembly 24 can be removed while leaving front cover 18 in place which leaves the pump drive components in place while the pump is serviced. Furthermore, when door 20 is in a closed and locked position, door 20 retains pump assembly 24 against end bell 12, thus facilitating assembly and disassembly of pump assembly 24 without using tools. These and other aspects are further discussed herein.

Figure 2:
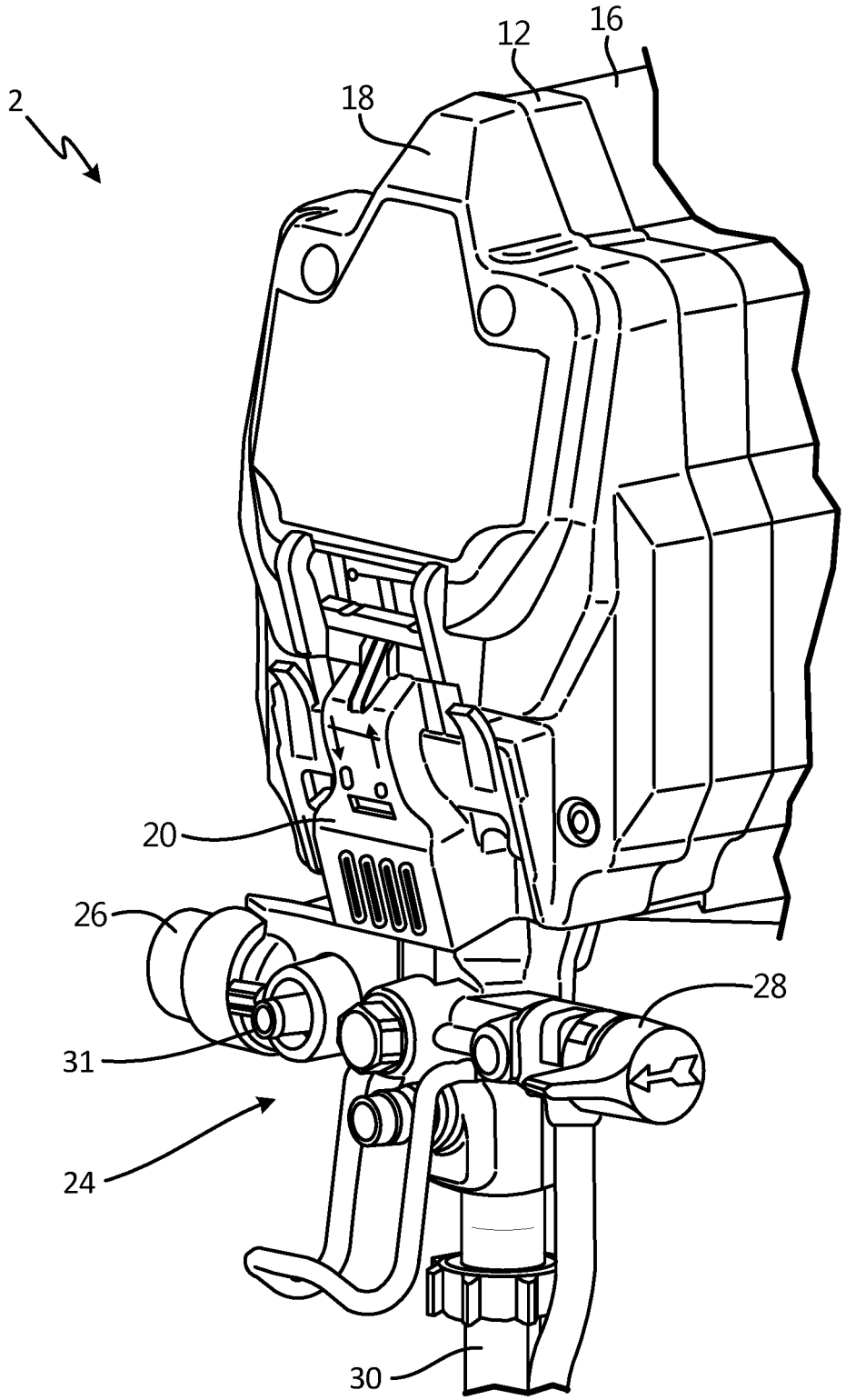
FIG. 2 is a detailed perspective view of the sprayer of FIG. 1 showing a door in a locked position.
Figure 3:
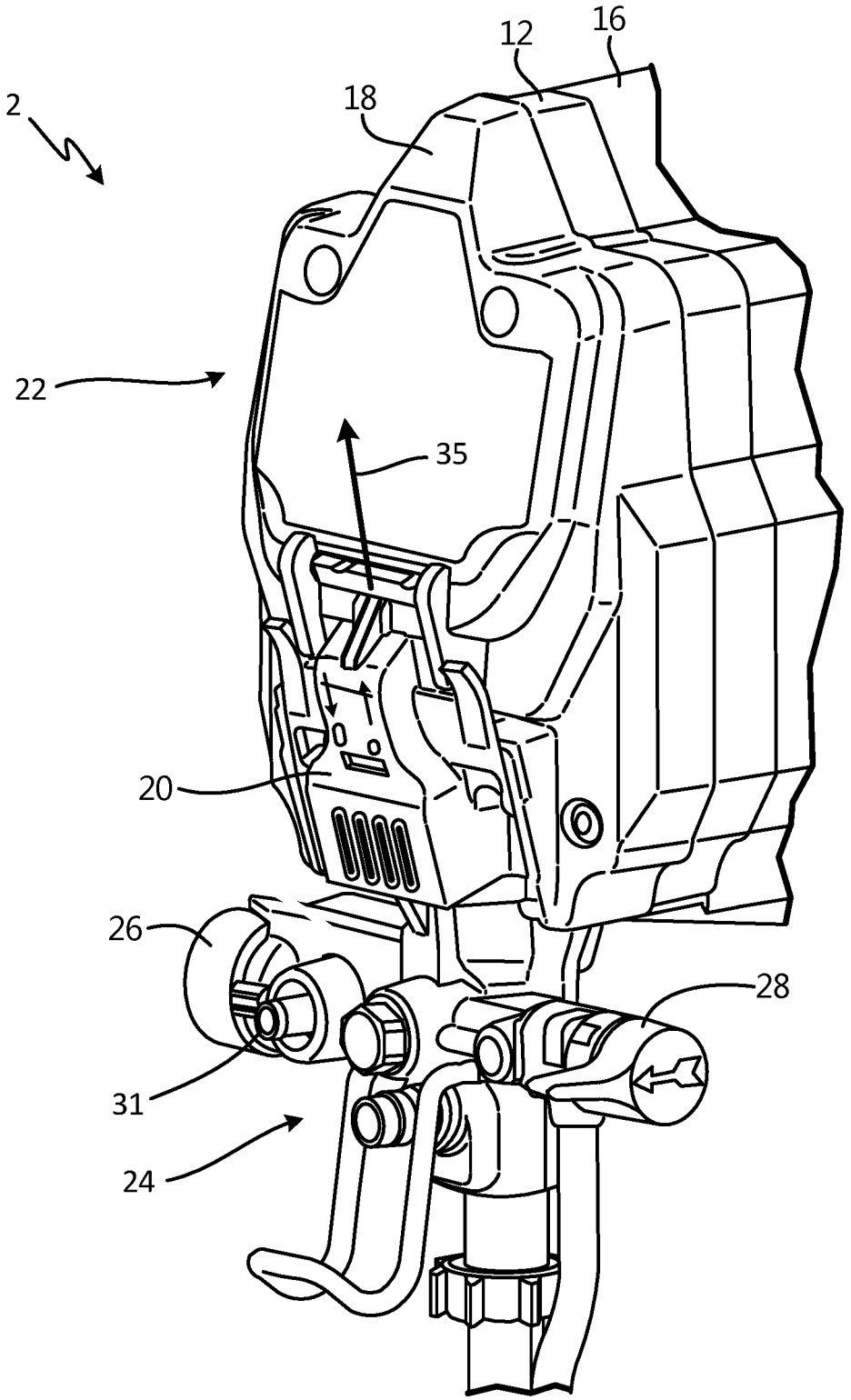
FIG. 3 is a detailed perspective view of the sprayer of FIG. 1 showing the door in an unlocked position.
Figure 4:
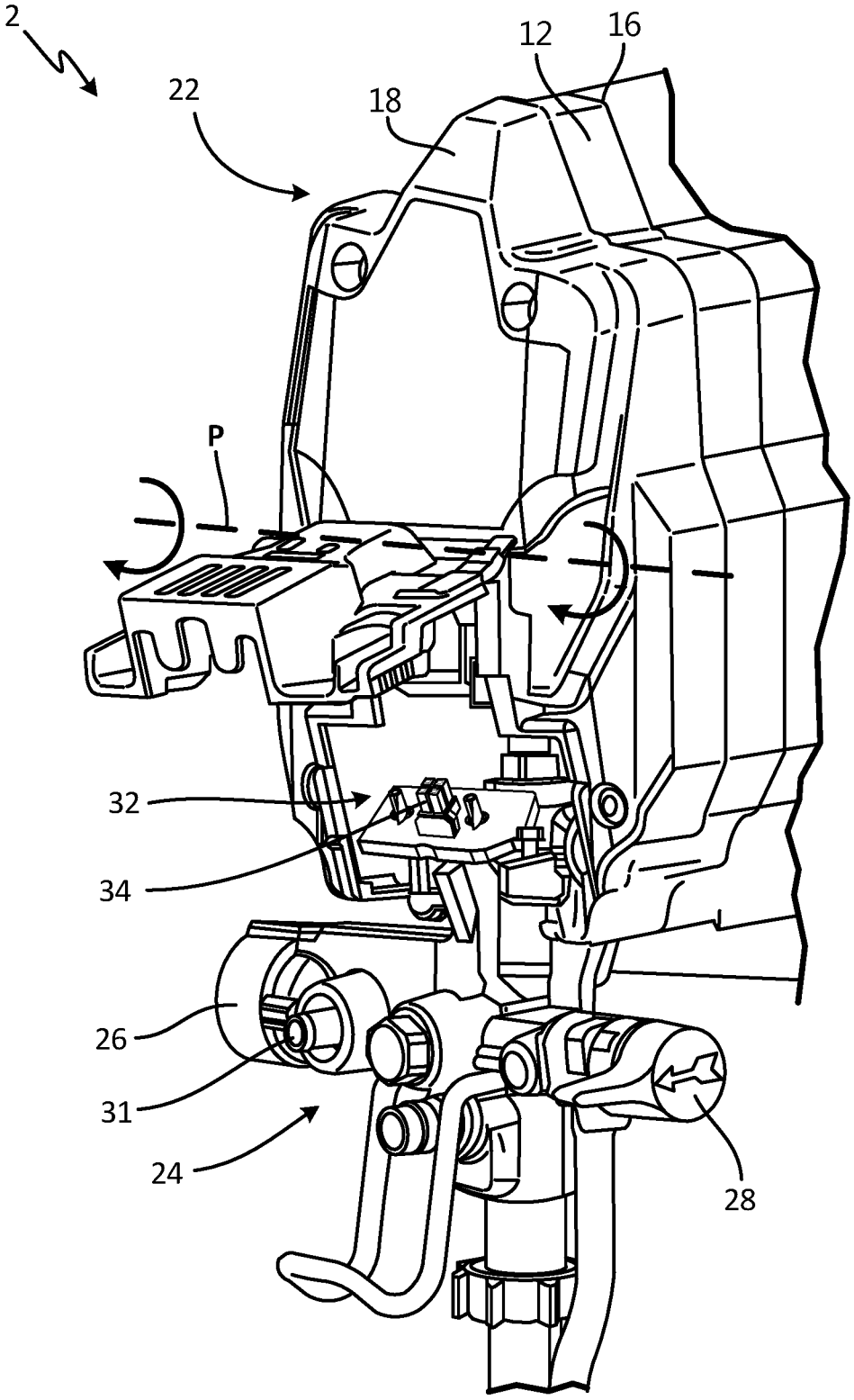
FIG. 4 is a detailed perspective view of the sprayer of FIG. 1 showing the door in an open position.

FIGS. 2-4 are detailed perspective views of front cover 18, door 20, and pump assembly 24 of sprayer 2. FIGS. 2-4 show the progression of opening door 20. Specifically, FIG. 2 shows door 20 in a locked position, sometimes referred to as a closed position. FIG. 3 shows door 20 in an unlocked position. FIG. 4 shows door 20 in an open position exposing enclosure interior 32 and electrical connector part 34. As demonstrated by FIGS. 2-4, door 20 opens by a sequential sliding-pivoting action explained as follows. First, sliding door 20 in direction 35 and within track 36 (not referenced by FIGS. 2-4) translates door 20 from the locked position in FIG. 2 to the unlocked position in FIG. 3. Direction 35 is substantially parallel with track 36 (not referenced in FIGS. 2-4) and corresponds to the direction door 20 translates between the locked position and the unlocked position (see FIGS. 2 and 3). As shown in FIG. 3, direction 35 is generally upwards. Although, direction 35 can be downwards, sideways, or another direction for other embodiments of door 20 and front cover 18. Track 36 (not referenced in FIGS. 2-4) limits door 20 to a linear sliding motion and prevents pivoting motion until door 20 is fully slid into the unlocked position of FIG. 3. Second, door 20 can pivot to transition from the unlocked position shown in FIG. 3 to the open position shown in FIG. 4, exposing enclosure interior 32 and fully exposing pump assembly 24. Thus, door 20 moves from the locked or closed position to the open position by sequential linear slide and pivot motions. To close door 20, the reverse process can be used. First, door 20 pivots from the open position in FIG. 4 to the unlocked position in FIG. 3. Second, door 20 slides in a direction opposite direction 35 from the unlocked position in FIG. 3 to the locked position in FIG. 2. Thus, door 20 moves from the open to the closed or locked positions by sequential pivot and linear slide motions. Once door 20 is in the locked position, at least a portion of door 20 engages and/or blocks pump assembly 24 to prevent translation of pump assembly 24 in a direction away from end bell 12. Details of door 20 and front cover 18 that facilitate the sliding and pivoting motion are discussed below.

Figure 5:
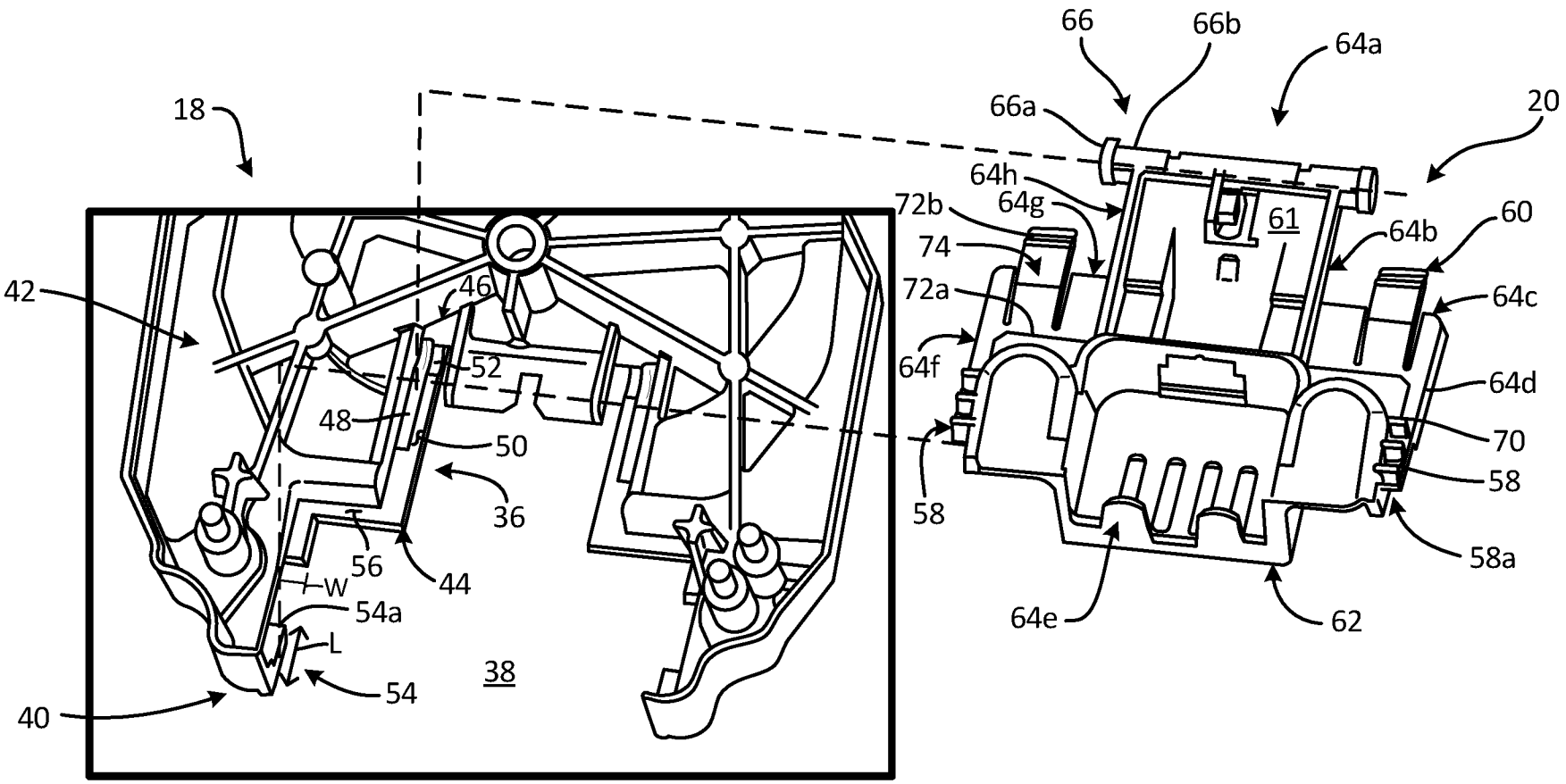
FIG. 5 is an exploded view from the interior of the sprayer showing features of the door that interface with the front cover.

FIG. 5 is an exploded view showing features of front cover 18 that interface with door 20 as viewed from the interior of sprayer 2. Front cover 18 includes opening 38 that extends through front cover 18 from exterior side 40 to interior side 42 of front cover 18. In FIG. 5, opening 38 is generally T-shaped and has the widest portion of the T positioned along a side of front plate 18. Other embodiments can have different sizes, shapes, and positions of opening 38 in which the details are selected based on the desired access to enclosure interior 32. Track 36 extends along opening 38 from first end 44 to second end 46 and includes channel 48. In the FIG. 5 embodiment, track 36 does not extend along the entire extent of opening 38, although other embodiments can include a track of this type.

Channel 48 forms a recess within front cover 18 that extends from second end 46 towards first end 44 and opens towards interior side 42 of front cover 18. Although channel 48 can extend the entire length of track 36 from second end 46 to first end 44 in some embodiments, here channel 48 extends a partial distance towards first end 44 as shown in FIG. 5. A partially-extending channel 48 retains the door within track 36. For example, the ends of channel 48 can be used to prevent excessive translation of door 20 beyond first end 44 and second end 46. Moreover, a portion of end bell 12 prevents door 20 from disengaging channel 48 in a direction generally perpendicular to track 36. With this arrangement, door 20 is coupled to front cover 18.

Track 36 can further include guiding surface 50 that extends from first end 44 to pivot bore 52 at or near second end 46. Guiding surface 50 is a flat face positioned between channel 48 and opening 38 and, as will be described below, abuts a mating face of door 20. Pivot bore 52 extends from channel 48 to opening 38 and has a cylindrical surface orientated to surround a pivoting portion of door 20 when it is in the unlocked and open positions. As configured, pivot bore 52 permits door 20 to pivot from the unlocked position to an open position and vice versa. Furthermore, a surface of door 20 abutting guiding surface 50 prevents rotation of door 20 along track 36 from the locked position (closed position) at first end 44 to a location near second end 46 where guiding surface 50 is adjacent pivot bore 52.

Front cover 18 can include one or both of catch 54 and locking surface 56 to restrain door 20 in the locked position. Generally, catch 54 and locking surface 56 form lips protruding into portions of opening 38 that are adapted to interface with latch 58 and tab 60 of door 20, respectively. Catch 54 interfaces with door 20 at inward-facing surface 54*a* (i.e., facing towards end bell 12 and enclosure interior 32) while locking surface 56 is also inward-facing to engage tab 60 of door 20. Catch 54 has width W that is perpendicular to a translation direction (i.e., direction 35) of door 20 and length L that is parallel to a translation direction of door 20, each being selected to interface with corresponding portions of door 20. Length L is less than a distance door 20 translates along track 36 from the locked position depicted in FIG. 2 to the unlocked position depicted in FIG. 3 to permit door 20 to disengage catch 54. In order to restrain an outward force imposed by door 20 on front cover 18 in the locked position, width W and length L are also selected based on shear and bending stresses calculated within catch 54 as is known in the art. Locking surface 56 mates with door 20 to restrain translation of door 20 from the locked position to the unlocked position as will be further explained in reference to tab 60 below.

Door 20 is adapted to be placed within opening 38 and, therefore, has a complimentary shape. More specifically, door 20 includes interior side 61 that faces towards enclosure interior 32 in the locked position and exterior side 62 facing in an opposite, outward direction. Side faces 64*a-h* extend from interior side 61 to exterior side 62 to define a body of door 20 and through which pivot axis P extends. Pivot axis P extends through door 20 adjacent to side face 64*a* which is adapted to interface with pivot bore 52 at second end 46 of track 36.

Door 20 further includes one or more trunnions 66 that can extend from one or more opposite side faces of door 20 that face track 36 in the locked and unlocked positions (e.g., side faces 64*b* and 64*h*). In some embodiments, trunnion 66 includes cylindrical portion 66*a* and cuboidal portion 66*b* that extend along pivot axis P. Cylindrical portion 66*a* is adapted to be received by channel 48 of front cover 18 while at least a surface of cuboidal portion 66*b* is adapted to abut guiding face 50 of front cover 18 in the locked and intermediate positions between the locked and unlocked positions. When door 20 is in the unlocked and open positions, pivot bore 52 surrounds cuboidal portion 66*b* to permit door 20 to rotate about pivot axis P. Trunnion 66 of some embodiments extends along and forms a side face of door 20 adapted to mate with second end 46 of track 36 (e.g., side face 64*a*). With such a configuration, cuboidal portion 66*b* extends between cylindrical portions 66*a* disposed at opposing ends of cuboidal portion 66*b*, each cylindrical portion 66*a* received by channels 48 disposed on opposite sides of opening 38. Because cylindrical portions 66*a* are restrained within channels 48 of front plate 18, door 20 is prevented from excessive side-to-side displacement (i.e., in a direction generally perpendicular and in the same plane as translation of door 20 along track 36. Alternatively, door 20 can have the opposite trunnion configuration in which trunnion 66 has cylindrical portion 66*a* disposed between cuboidal portions 66*b* placed on opposing sides of door 20. Moreover, instead of cuboidal portion 66*b*, door 20 can include a flat surface formed by removing material from a portion of cylindrical portion 66*a* that engages guiding surface 50. In each embodiment of trunnion 66, door 20 is restrained by mating surfaces of trunnion 66 and track 36.

Door 20 can further include latch 58 formed by or protruding from at least one side face 66*a-h*. For example, latch 58 can be formed by side faces 64*d* and 64*f* of door 20, where each of side faces 64*d* and 64*f* is positioned to face catch 54 of front panel 18. Latch 58 has surface 58*a* that faces towards exterior side 62 and, thus, faces away from enclosure interior 32 in the locked position. Furthermore, surface 58*a* is adapted to abut inward facing catch surface 54*a* by having complimentary shapes and sizes that engage in the closed position. Latch 58 can include one or more ribs 70 extending from latch 58 towards interior side 61 of door 20 to increase the strength of latch 58 in bending.

Door 20 can include a locking mechanism to limit sliding of door 20 from the locked position. For example, tab 60 can be configured within a cutout extending through door 20 from interior side 61 to exterior side 62. In this example, tab 60 is affixed to door 20 within the cutout at attachment end 72*a* and is unrestrained by door 20 at engagement end 72*b*, which extends beyond side face 64*g* of door 20. Lip 74 projects from tab 60 between attachment end 72*a* and engagement end 72*b* and interfaces with locking surface 56 in front cover 18 (or alternatively lip 74 can project from locking surface 56 to engage a surface of tab 60) in a locking manner. To slide door 20 from the locked position in FIG. 2 to the unlocked position in FIG. 3, tab 60 disengages lip 74 from locking surface 56 and allows the sliding motion of door 20 along track 36. To disengage lip 74 from locking surface 56, tab 60 is lifted away from the front cover 18 by applying a force to engagement end 72*b*, whereas tab 60 is otherwise biased toward front cover 18 to keep lip 74 and locking surface 56 engaged. Some embodiments of tab 60 have an undeflected shape that interferes with locking surface 56 in the locked position of door 20. By deflecting tab 60 in this manner, a restoring moment acts on tab 60 about attachment end 72*a* to bias tab 60 towards front plate 18 when door 20 is in the locked position. Moreover, door 20 can include one or more tabs 60 to restrain door 20 in the locked position. For example, the embodiment depicted by FIG. 5 includes two tabs 60 positioned on opposite sides of door 20, each tab engaging locking surface 56 of front cover 18.

Figure 6:
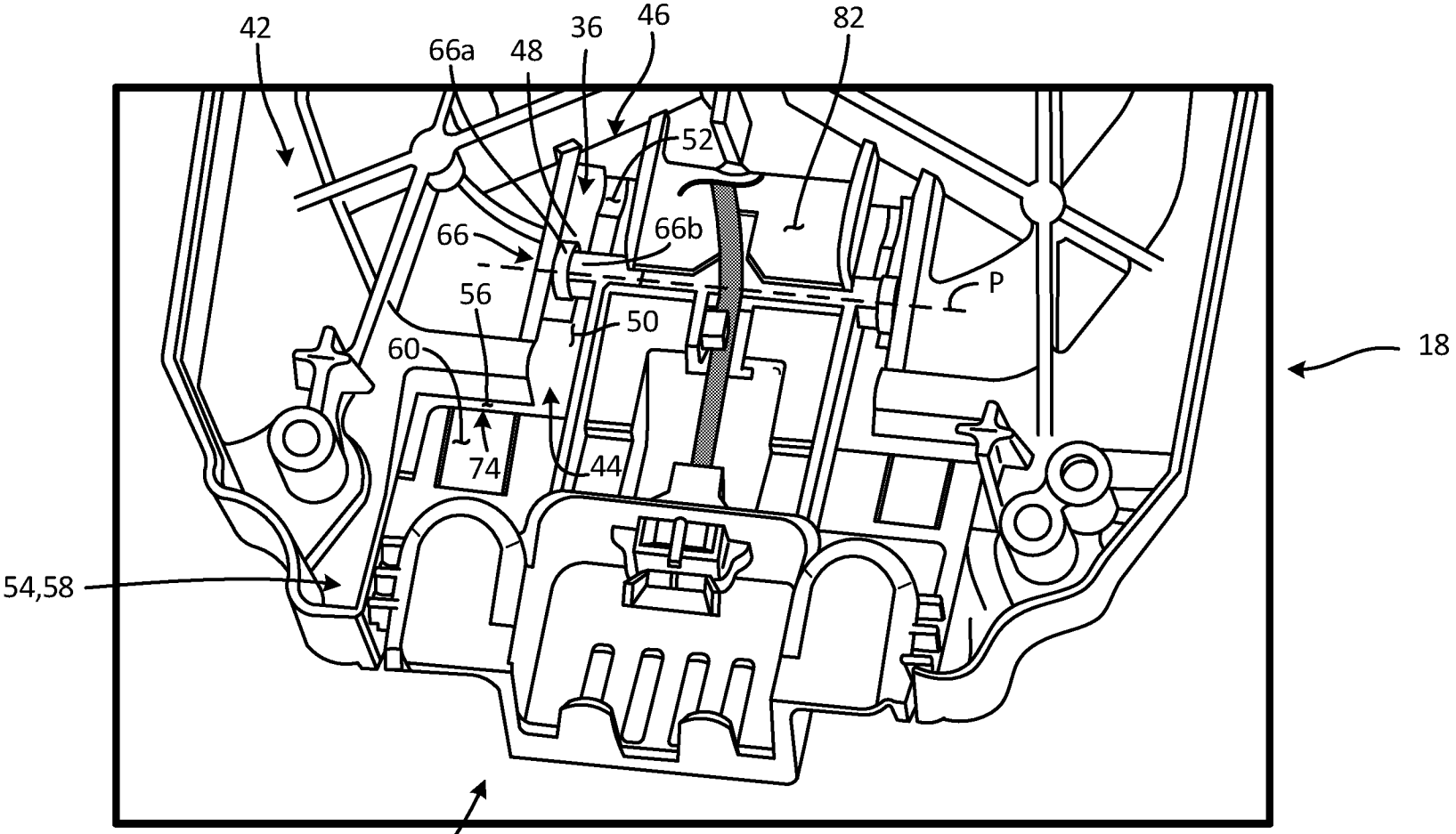
FIG. 6 is a perspective view from the interior of the sprayer showing the door assembled to the front cover.

FIG. 6 is a perspective view of front cover 18 and door 20 in the locked position as viewed from interior side 42 of front cover 18. In the locked position, cylindrical portion 66*a* of trunnion 66 is received within channel 48 of front cover 18 and a face of cuboidal portion 66*b* abuts guiding surface 50. The surface of cuboidal portion 66*b* that abuts guiding surface 50 resists rotation of door 20 about pivot axis P. Additionally, lip 74 of tab 60 engages locking surface 56 and thereby restrains translation of door 20 from first end 44 towards second end 46 of track 36. When, catch 54 and latch 58 are engaged, mating surfaces 54*a* and 58*a* (see FIG. 5) further restrain rotation of door 20 about pivot axis P.

Figure 7:
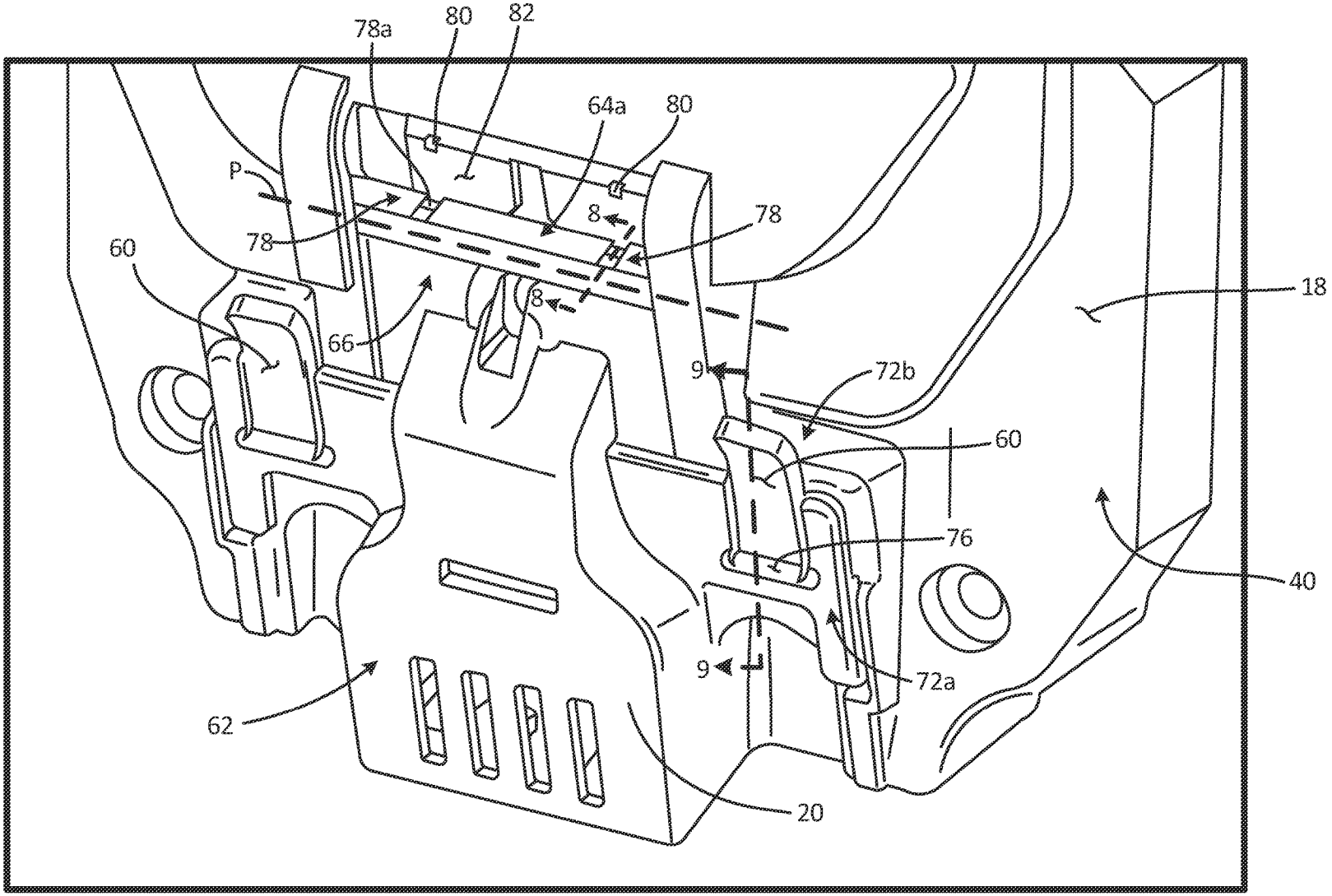
FIG. 7 is a perspective view from the exterior of the sprayer showing the door assembled to the front cover.

FIG. 7 is a perspective view of front cover 18 and door 20 in the locked position as viewed from exterior side 40 of front cover 18. Because door 20 is in the locked position, tabs 60 are engaged with locking surface 56 (see FIGS. 5 and 6). To extend the life of tabs 60 and to facilitate disengagement of tabs 60 from locking surface 56, tabs 60 include thickened portion 76 at attachment end 72*a*. Because tabs 60 are disengaged from front cover 18 by applying a force to engagement end 72*b* and thereby displacing engagement end 72*b* away from front cover 18, bending stress is imposed on tab 60 at attachment end 72*a*. Thickened portion 76 increases a nominal thickness of tab 60 at attachment end 72*a* which in turn tends to reduce bending stress at attachment end 72*a*.

Figure 8:
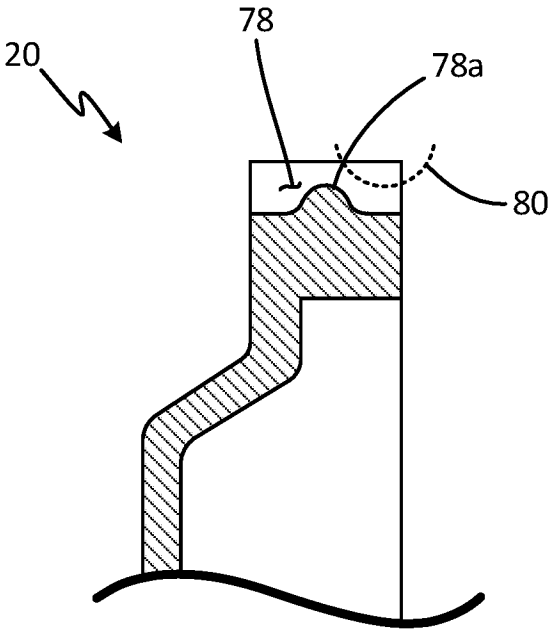
FIG. 8 is a cross-sectional view of the door taken along line 8-8 in FIG. 7 showing a groove for holding the door in the open position.

Front cover 18 and door 20 can optionally include features for restraining rotation of door 20 about pivot axis P when door 20 is in the open position. For example, door 20 can include one or more grooves 78 that extend from exterior side 62 to interior side 61 of door 20 and transverse to a lengthwise direction of side surface 64*a*, a surface that forms a portion of trunnion 66. As shown in FIG. 8, a cross-sectional view taken along line 8-8, surface 78*a* of each groove 78 is contoured to mate with a complimentary contour of one or more protuberances 80 (shown schematically) of front plate 18. Protuberances 80 protrude from auxiliary plate 82, and auxiliary plate 82 extends from interior side 42 (see FIG. 6) of front plate 18. When door 20 is positioned within opening 38 in the closed position, auxiliary plate 82 also extends along interior side 61 of door 20. Accordingly, when door 20 is translated to the unlocked position (i.e., upwards relative to front plate 18 as shown in FIG. 7) and subsequently rotated about pivot axis P into the open position, surface 78*a* of groove 78 engages protuberance 80 and thereby holds door 20 in the open position by restraining rotation of door 20 about pivot axis P.

Figure 9:
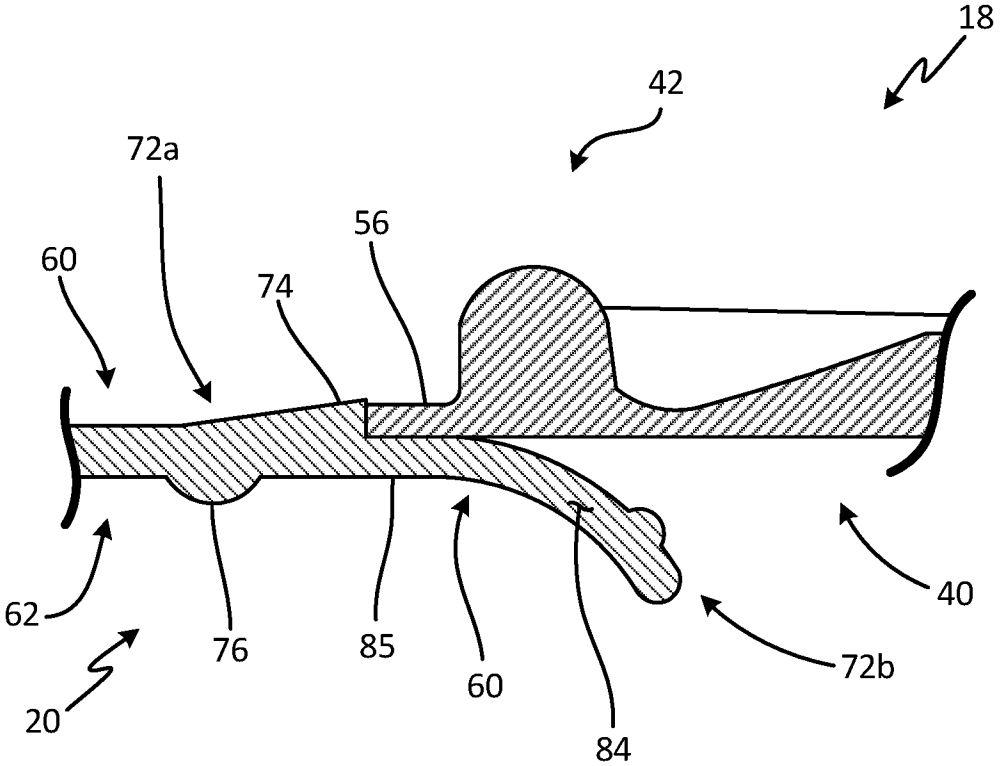
FIG. 9 is a cross-sectional view of the door taken along line 9-9 in FIG. 7 showing a door tab engaging the front plate in a locked position.

FIG. 9 is a cross sectional view of tab 60 taken along line 9-9 in FIG. 7 when door 20 is in the locked position. With door 20 in the locked position, lip 74 protrudes from tab 60 to engage locking surface 56 of front plate 18. Because tab 60 is affixed to door 20 at attachment end 72*a* and unrestrained by door 20 at engagement end 72*b*, tab 60 is flexible in bending about attachment end 72*a*. Applying a force to engagement end 72*b* displaces tab 60 away from front plate 18 and thereby disengages lip 74 from locking surface 56. Typically, tabs 60 are actuated by hand. To facilitate actuation of tab 60, tab 60 can include curved portion 84. With curved portion 84, tab 60 extends from attachment end 72*a* along front plate 18 and exterior side 62 of door 20 and is curved between intermediate location 85 and engagement end 72*b* such that tab 60 extends away from front plate 18, providing additional access to tab 60 for hand operation.

Figure 10:
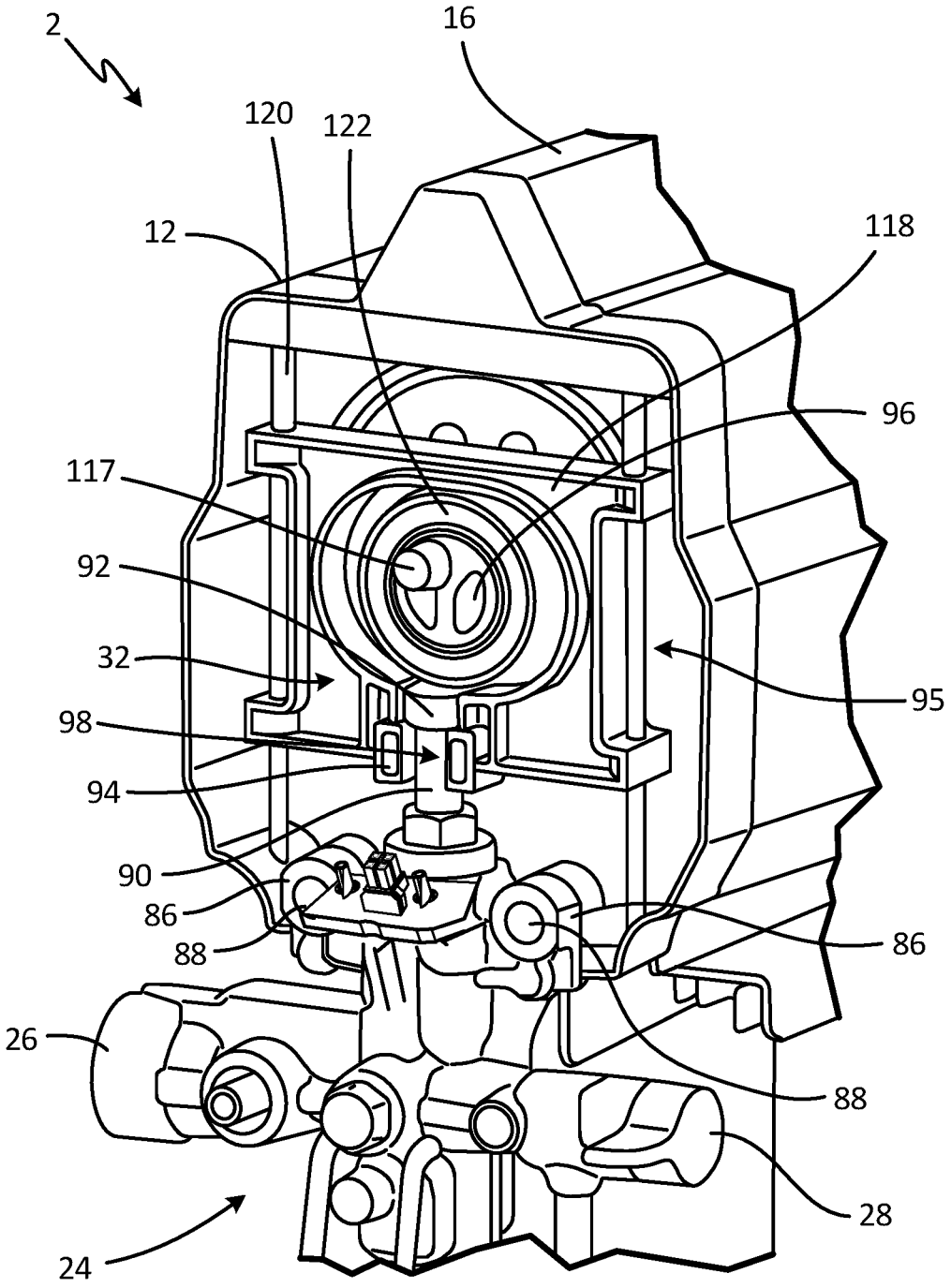
FIG. 10 is a perspective view of the sprayer with the front cover removed to show a pump assembly engaging a structural member of the sprayer.

FIG. 10 is a perspective view of sprayer 2 with front cover 18 removed to show pump assembly 24 mounted to end bell 12 within sprayer 2. Pump assembly 24 includes mounting holes 86 which are formed by a component of pump assembly 24 (e.g., a housing) or an external component joined to pump assembly 24. Mounting holes 86 are adapted to receive protrusions 88, which are joined to and extend from end bell 12. The number and configuration of mounting holes 86 and protrusions 88 are selected to restrain pump assembly 24 with respect to end bell 12, and more particularly, to restrain a pumping motion of pump assembly 24 with respect to end bell 12 while permitting pump assembly 24 to translate freely for assembly and disassembly from sprayer 2. Additionally, with front cover removed, various components of the pump drive can be accessed and removed for repair, cleaning, or other maintenance.

In the embodiment shown, pump assembly 24 includes piston 90 that reciprocates along a lengthwise direction of piston 90 (i.e., upward and downward directions as depicted in FIG. 10). To restrain the reciprocating motion of piston 90, pump assembly 24 includes a pair of mounting holes 86, each mounting hole 86 disposed on opposing sides of piston 90. Mounting holes 86 are spaced equally from piston 90 such that the load imposed on each mounting hole 86 is substantially equal. The centerline of piston 90 is equally spaced between mounting holes 86, but is offset with respect to the centerline of the gear 96 of drive assembly 23. This is done so that the load is centered on piston 90 during the downstroke, which is the highest pumping load. During the upstroke, piston 90 only has to overcome the drag of the packing assembly. The pair of mounting holes 86 is adapted to receive a pair of protrusions 88. The pair of protrusions 88 extends in a longitudinal direction from a side of end bell 12 that is opposite electric motor 23, and can be substantially perpendicular to a reciprocating direction of piston 90. Furthermore, each protrusion 88 can be substantially parallel to each other protrusion 88 and thereby facilitate removing pump assembly 24 by sliding pump assembly 24 along the longitudinal direction away from end bell 12.

Thus, the mounting interface between pump assembly 24 and end bell 12, whether configured as a discrete component or integrated into a support frame, includes a pair of mounting holes 86 and a pair of protrusions 88 cantilevered from end bell 12. As configured in FIG. 10, the pairs of mounting holes 86 and protrusions 88 restrain pumping assembly 24 relative to end bell 12 against the reciprocating motion of piston 90 when pump assembly 24 is slid onto protrusions 88. Additionally, the reception of protrusions 88 within mounting holes 86 permit pump assembly 24 to be mounted to or removed from sprayer 2 without tools when door 20 is in the open position. With the configuration depicted by FIG. 10, the weight of pump assembly 24 is supported by end bell 12 via protrusions 88 and is not supported by front cover 18.

In FIG. 10, mounting holes 86 take the form of bores that extend through a component of pump assembly 24. The bores form cylindrical bearing surfaces that are sized to form a sliding fit with protrusion 88, which take the form of cylindrical pins. Protrusions 88, particularly if protrusions 88 are formed by discrete pins, can be press fit into a recess within end bell 12. Alternatively, protrusions 88 can be attached to end bell 12 using other methods such as welding or brazing, or protrusions 88 can be integrally machined into end bell 12. Protrusions 88 extend a distance in the longitudinal direction that is less than the distance between front cover 18 and end bell 12. In this instance, protrusions 88 do not contact and are not mechanically supported by front cover 18.

Pump assembly 24 further includes collar 92 that is adapted to engage coupler 94 of pump drive 95. Collar 92 is joined to piston 90 and is configured to permit installation and removal of pump assembly 24 from sprayer 2 without tools. For example, collar 92 can be integrally formed at a free end of piston 90 or joined to a free end of piston 90. When pump assembly 24 is installed within sprayer 2, such as FIG. 10 depicts, coupler 94 and output gear 96 restrain collar 92 in a reciprocating direction of piston 90. To facilitate installation and disassembly of pump assembly 24 without tools, coupler 94 has open end 98 that faces away from end bell 12 (i.e., in an outward direction). In some embodiments, coupler 94 has a U-shaped cross-section, open end 98 being situated between side portions of the U-shaped coupler 94. With this configuration, piston 90 of pump assembly 24 is received between side portions of U-shaped coupler 94 when pump assembly 24 is assembled within sprayer 2 by sliding mounting holes 86 on to protrusions 88.

Figure 11:
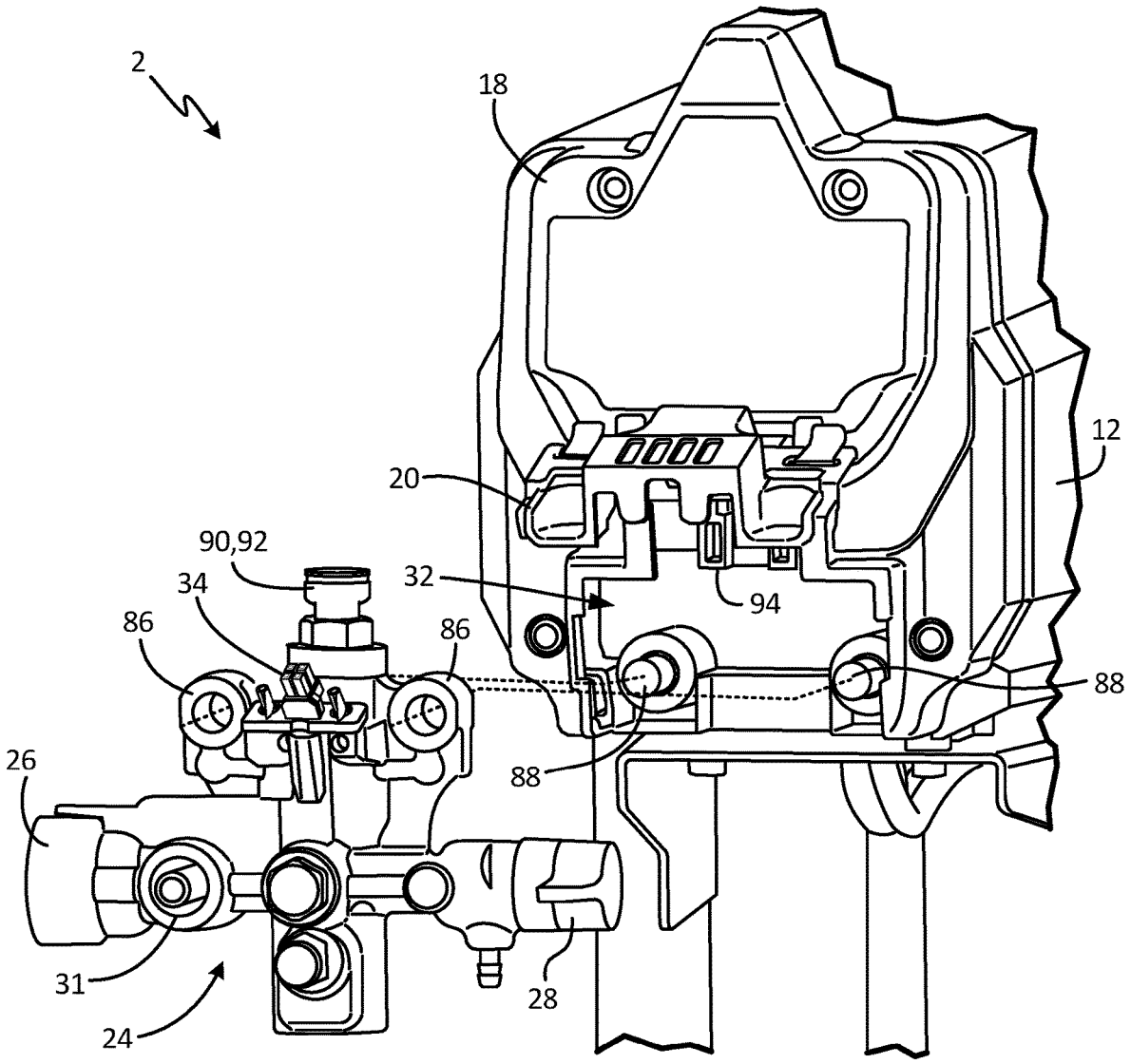
FIG. 11 is an exploded view that shows the pump assembly of FIG. 10 removed from the sprayer.

FIG. 11 is an exploded view that shows pump assembly 24 after mounting holes 86 have been slid off of pin-shaped protrusions 88. Such forward sliding motion (i.e., in a direction away from end bell 12) allows piston 90 to be disengaged from coupler 94 and mounting holes 86 to slide off and disengage protrusions 88. Once separated from the rest of the sprayer 2, pump assembly 24 can be serviced. For example piston 90 can be removed and packing seals, check valves, and/or other components can be cleaned or replaced. As noted previously, the removal of the pump assembly 24 via the enclosure interior 32 being exposed by pivoting of the door 20 allows the servicing of the pump without removal of the front cover 18. It is noted that the front cover 18 helps secure the components of pump drive 95 such as output gear 96 and coupler 94 among various other components such that pump assembly 24 can be removed through an open door 20 without detaching or otherwise exposing components of pump drive 95 contained between front cover 18 and end bell 12 and electric motor 23 (see FIG. 1) within motor housing 16 (see FIG. 1).

While the sliding action of door 20 from the locked position or closed position to the unlocked position and vice versa can serve as a mechanical lock that prevents door 20 from swinging open (the pivoting motion otherwise meeting minimal mechanical resistance), the sliding action can also establish and break an electrical connection. For example, as discussed previously, pressure control 26 can electrically control the state motor 23 within motor housing 16 (see FIG. 1). However, if pump assembly 24 is to be removed, and the pressure control 26 is contained on the pump assembly 24, then one or more wired connections extending from the pressure control 26 to motor 23 may need to be broken to remove pump assembly 24. The sliding motion of the door 20 is a convenient motion for establishing and breaking a robust electrical connection. The electrical connection is established and broken in part using electrical connector part 34, which is mounted on pump assembly 24. One or more insulated wires can run along pump assembly 24 via a cable and between pressure control 26 and electrical connector part 34. The electrical connection is further explained in connection with FIGS. 12A-C.

Figure 12A:
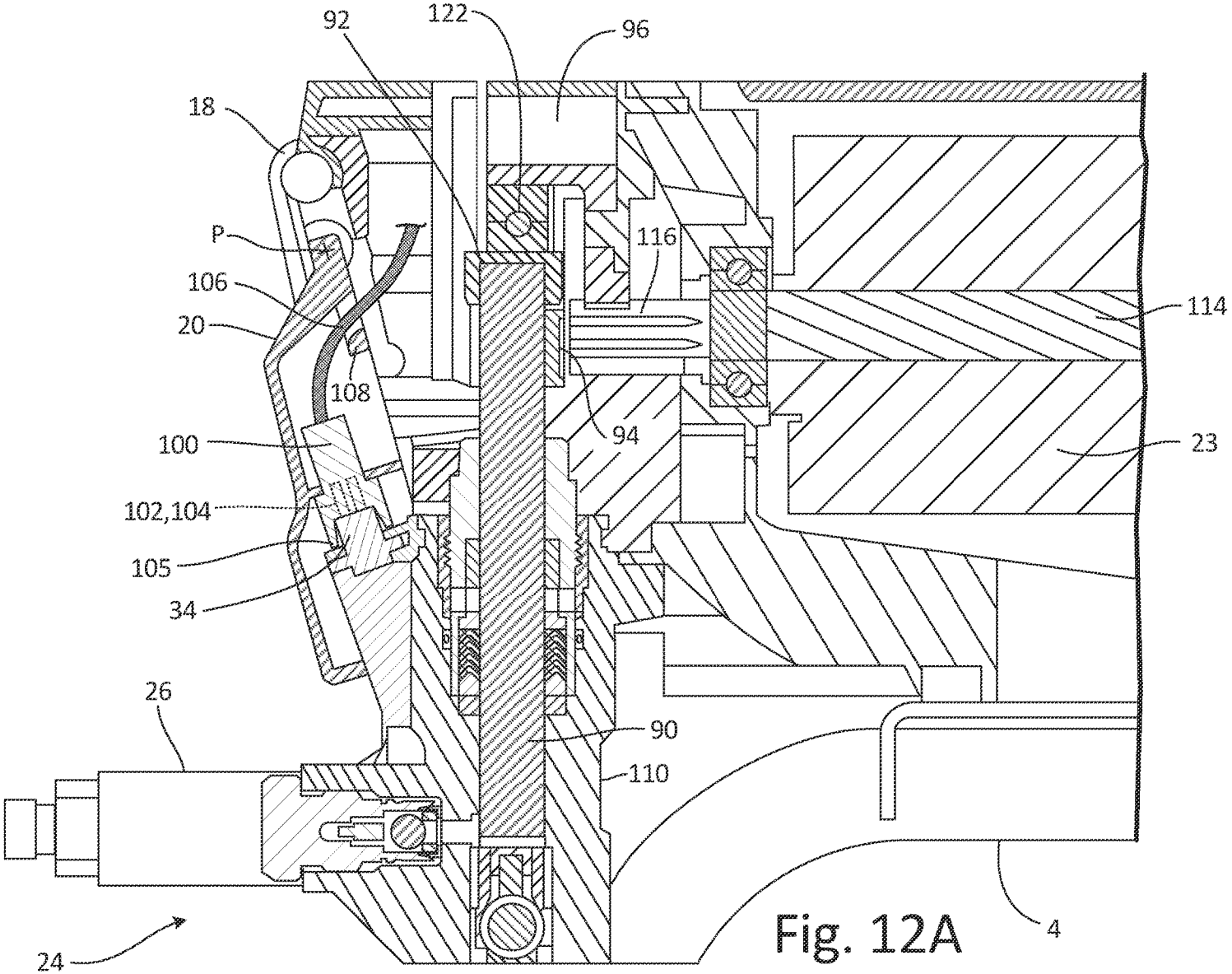
FIG. 12A is a cross-sectional view of the sprayer showing the door in the locked position.
Figure 12B:
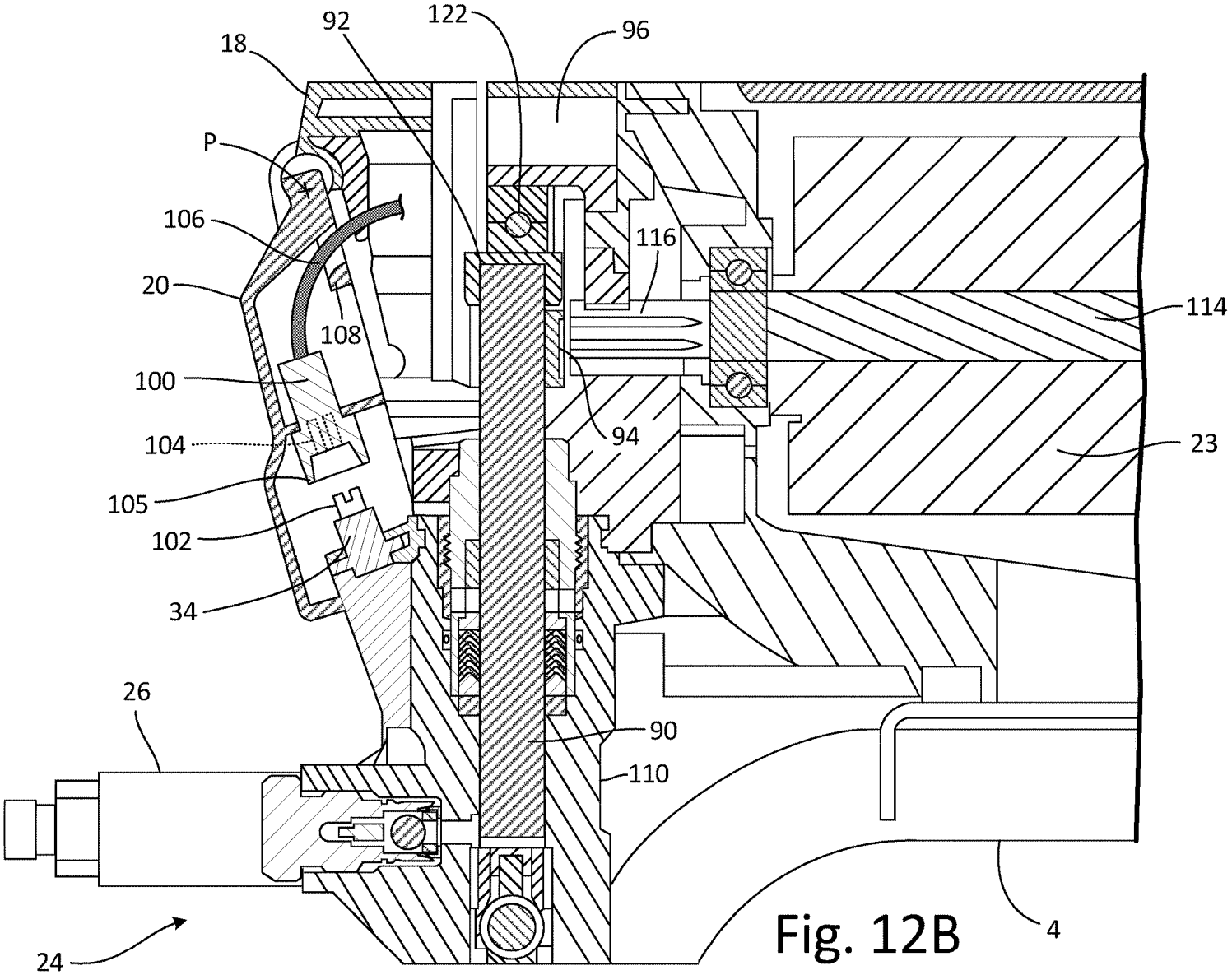
FIG. 12B is a cross-sectional view of the sprayer showing the door in the unlocked position.
Figure 12C:
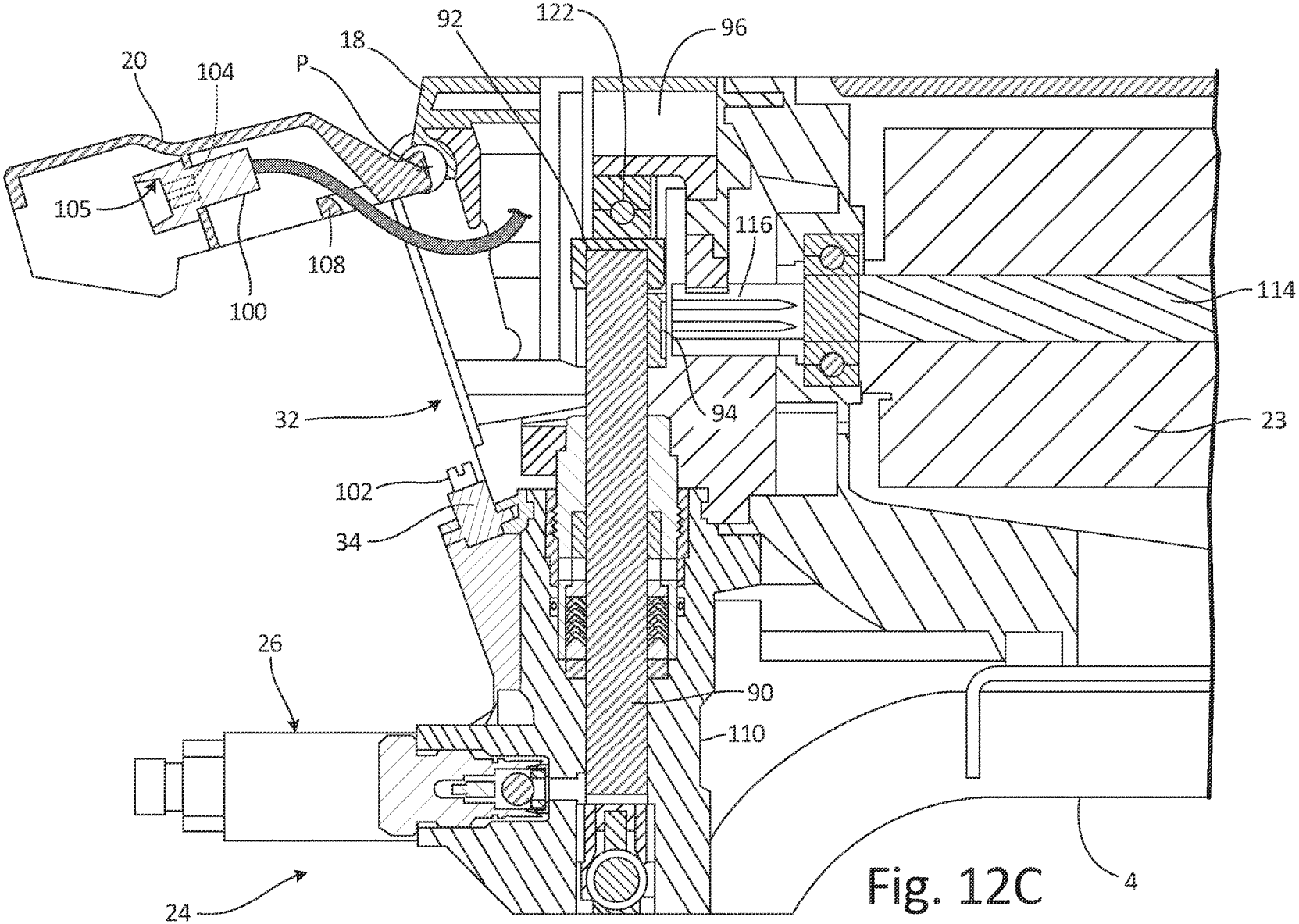
FIG. 12C is a cross-sectional view of the sprayer showing the door in the open position.

FIGS. 12A-C show a cross sectional view of sprayer 2 in the states shown in FIGS. 2-4, respectively. Specifically, FIG. 12A shows door 20 in a locked position or closed position, FIG. 12B shows door 20 in an unlocked position, and FIG. 12C shows door 20 in an open position. FIGS. 12A-C also show electrical connector part 100 which is connected to and moves with the door 20. Parts 34 and 100 of the electrical connector are separate parts that include interfacing electrical contacts. When engaged as shown in FIG. 12A, parts 34 and 100 establish an electrical connection that is used to conduct a signal from pump assembly 24 to a component within enclosure 22. For example, parts 34 and 100 can conduct a signal from pressure control 26 to motor 23 when engaged. Contrastingly, an electrical connection is broken when parts 34 and 100 disengage, as in the unlocked state of FIG. 12B or the open state of FIG. 12C. When disengaged, signals from the pump assembly 24, such as a pressure-control signal from pressure control 26, are prevented from conducting through parts 34 and 100 of the electrical connector. Details of the electrical connector are described below.

As best shown in FIGS. 12B-C, electrical connector part 34 includes one or more projections 102 that are received in one or more recesses 104 of electrical connector part 100. Alternately, electrical connector part 34 could include one or more recesses that receive one or more projections of electrical connector part 100. The reception of a projection in a recess can create an elongated seal to prevent paint, or another material dispensed from sprayer 2, from reaching the electrical contacts within the electrical connector parts 34 and 100. The sliding motion of door 20 relative to front cover 18 facilitates the reception of a long projection (e.g., projection 102) within a deep recess (e.g., recess 104), and therefore facilitates the electrical isolation of the electrical connection established between electrical connector parts 34 and 100 from paint.

The distance that parts 34 and 100 of electrical connector overlap defines an engagement length. In embodiments of front plate 18 and door 20 that include catch 54 and latch 58, respectively, the engagement length is less than length L of catch 54. With this arrangement, electrical connector parts 34 and 100 fully disengage before door 20 is in the unlocked position, which prevents damage to electrical connector parts 34 and 100 from premature pivoting of door 20 into the open position. In other embodiments, the engagement length is at least half the linear distance door 20 translates from the locked position to the unlocked position. In each embodiment, the engagement length forms a seal between parts 34 and 100 of the electrical connector by creating a tortuous path that prevents infiltration of debris and the material dispensed from sprayer 2.

Some embodiments of electrical connectors include sleeve 105 that encircles one of parts 34 and 100 of the electrical connector. Sleeve 105 extends from either part 34 or part 100 towards the other of parts 34 and 100 when viewing door 20 in the locked position. Interior surfaces of sleeve 105 are tapered inward from a distal end towards a proximal end for at least a portion of sleeve 105 to facilitate engagement of parts 34 and 100 when door 20 is translated into the locked position or closed position. For example, FIGS. 12A-C show part 100 equipped with sleeve 105. As best shown in FIG. 12B, the interior surfaces of sleeve 105 are tapered such that the open area cross-section of sleeve 105 at an end facing part 34 (i.e., the distal end) is larger than the open area cross-section of sleeve 105 at an end of sleeve 105 connected to part 100 of the electrical connector (i.e., the proximal end). Embodiments utilizing sleeve 105 tolerate small amounts of misalignment between door 20 and pump assembly 24 when door 20 translates into the locked position.

Part 100 of the electrical connector connects with one or more wires that extend along the pivoting connection between the door 20 and the front cover 18 and can further extend to the motor to relay control signals between the pressure control 26 and the motor (e.g., on and off signals). These wires can form cable 106.

Some embodiments include cable support 108 to support cable 106 with respect to door 20. In these embodiments, cable 106 extends from electrical connector part 100 through cable support 108. Cable support 108 protrudes from a portion of door 20 adjacent to pivot axis P such that a gap is formed between an interior surface of door 20 and cable support 108. In some embodiments, cable support 108 can be contoured to support cable 106 at a bend when door 20 is pivoted between the unlocked position and the open position as is generally depicted by FIGS. 12B and 12C. By contouring cable support 108, damage and wear to cable 106 caused by translating and pivoting door 20 can be reduced or eliminated. Other embodiments are further equipped with an aperture extending through door 20 and aligned with cable support 108 to facilitate threading cable 106 through the gap created by cable support 108.

The perspective view of FIG. 10 and the cross sectional views of FIGS. 12A-C show various additional components of sprayer 2. For example, the views show that pump assembly 24 includes cylinder 110 within which piston 90 reciprocates, as driven by motor 23, to pump paint. The cross sectional views of FIGS. 12A-C also show that shaft 114 driven by motor 23 engages input gear 116. Input gear 116 is affixed rotationally to shaft 114 and is rotatably coupled to output gear 96, which is coupled to coupler 94 (sometimes referred to as a yoke). As best depicted by FIG. 10, output gear 96 includes eccentric shaft 117 that is offset from a rotational axis of output gear 96 and extends into an egg-shaped bore of carrier 118. Carrier 118 is allowed to slide along at least one rail 120, which is restrained by one or both of end bell 12 and front cover 18. A bearing 122 can be positioned between eccentric shaft 117 and carrier 118 to reduce frictional forces generated by the relative motion of carrier 118 and output gear 96.

In operation, the shaft 114 rotates input gear 116, which in turn drives output gear 96. Output gear 96 causes eccentric shaft 117 to oscillate within the egg-shaped bore of carrier 118 such that rotational motion of output gear 96 is converted to reciprocating motion (i.e., linear up-and-down motion as depicted in FIG. 10) of carrier 118 along rail 120. On the downstroke, gear 96 engages bearing 122 to push down piston 90, and while on the upstroke, gear 96 pulls coupler 94 upwards. In turn, coupler 94 pulls piston 90 upwards. In this embodiment, output gear 96, eccentric shaft 117, carrier 118, rails 120, and bearing 122 form pump drive 95. This is one example of a pump drive and pump configuration, and it is noted that various other types of pumps and pump drives can be used with the other features discussed herein, such as door 20.

Discussion of Possible Embodiments

The following are non-exclusive descriptions of possible embodiments of the present invention.

Example 1

A paint sprayer according to an exemplary embodiment of this disclosure includes, among other possible things, an end bell, a motor connected to the end bell, a pump drive connected to the end bell, a pair of protrusions attached to an extending from the end bell such that each protrusion is cantilevered from the end bell, and a pump assembly comprising a pair of mounting holes and containing a piston. The pair of mounting holes are adapted to receive and slide onto the pair of protrusions to mount the pump assembly on the end bell as well as slide off of the pair of protrusions to remove the pump assembly from the end bell. The pump drive is configured to covert rotational motion output by the motor to reciprocal motion. The pump assembly is configured to pump paint when reciprocated by the pump drive while mounted on the end bell.

The paint sprayer of the preceding example can optionally include, additionally and/or alternatively, any one or more of the following features, configurations and/or additional components:

A further embodiment of the foregoing paint sprayer, wherein each of the pair of protrusions extends parallel with each other and extends from the end bell.

A further embodiment of any of the foregoing paint sprayers, wherein the pair of protrusions holds the pump assembly in place relative to the end bell during reciprocation of the piston pump.

A further embodiment of any of the foregoing paint sprayers, wherein each protrusion of the pair of protrusions is cylindrical and each of the mounting holes are correspondingly cylindrical.

A further embodiment of any of the foregoing paint sprayers can further include a front cover in which the front cover is mounted to the end bell such that the pump drive is located between the front cover and the end bell.

A further embodiment of any of the foregoing paint sprayers, wherein the front cover can hold the pump drive in place such that detachment of the front cover from the end bell allows the pump drive to be removed from the paint sprayer.

A further embodiment of any of the foregoing paint sprayers, wherein the pump assembly can be slid off of the pair of projections to remove the pump assembly while the front cover remains attached to the end bell and the pump drive remains located between the front cover and the end bell.

A further embodiment of any of the foregoing paint sprayers can include a door attached to the front cover in which the door is moveable between an open position and a closed position, wherein the door blocks the pump assembly from being slid off of the pair of projections while in the closed position but permits the pump assembly to be slid off of the pair of projections while in the open position to remove the pump assembly.

A further embodiment of any of the foregoing paint sprayers, wherein the weight of the pump assembly is not supported by the front cover when the pump assembly is mounted on the end bell by receiving the pair of protrusions.

A further embodiment of any of the foregoing paint sprayers, wherein the pair of projections do not contact the front cover when the front cover is mounted to the end bell.

A further embodiment of any of the foregoing paint sprayers, wherein the door moves from the closed position to the open position by sequential linear slide then pivot motions, and the door moves from the open position to the closed position by sequential pivot then linear slide motions.

A further embodiment of any of the foregoing paint sprayers, wherein the cover comprises a track within which the door moves while the door undergoes the liner sliding motion.

A further embodiment of any of the foregoing paint sprayers, wherein an interface of the track and the door prevents the door from pivoting while the door undergoes at least part of the liner sliding motion.

A further embodiment of any of the foregoing paint sprayers can further include one or more tabs and one or more locking surfaces, the one or more tabs biased to respectively interface with the one or more locking surfaces to lock the door in the closed position, the one or more tabs configured to be lifted away from the one or more locking surfaces to permit the door to undergo the liner sliding motion.

A further embodiment of any of the foregoing paint sprayers can further include an electrical connector located, in separate interfacing parts, on each of the pump assembly and the door.

A further embodiment of any of the foregoing paint sprayers can further include a pressure control located on the pump assembly, the pressure control configured to output a signal that is used to regulate operation of the motor, the signal conducted through the electrical connector.

A further embodiment of any of the foregoing paint sprayers, wherein the sliding motion of the door in a first direction moves the door to the closed position and completes an electrical connection that permits the signal to travel through the electrical connector, and wherein the sliding motion of the door in a second direction moves the door to the open position and breaks the electrical connection to prevent the signal from traveling through the electrical connector.

A further embodiment of any of the foregoing paint sprayers, wherein the pump drive can include one or more gears, and the pump drive further comprises at least one of a yoke or a crank.

A further embodiment of any of the foregoing paint sprayers, wherein the end bell can include a first side and a second side opposite the first side, wherein the motor is located on the first side, and the pump drive and the pair of projections are located on the second side.

A further embodiment of any of the foregoing paint sprayers can further include a frame, wherein the end bell is a plate that is mounted on the frame.

Example 2

A paint sprayer according to another exemplary embodiment of this disclosure includes, among other possible things, a support frame with a first side and a second side, a front cover connected to the support frame, a motor located on the first side of the support frame, a pump drive located on the second side of the support frame and between the front cover and the support frame, a pump assembly holding a piston pump, a door attached to the front cover, and a mounting interface. The mounting interface includes a pair of cantilevered protrusions and a pair of mounting holes. The pump assembly is removably mounted to the support frame by reception of the pair of cantilevered protrusions within the pair of mounting holes. The pump drive is configured to convert rotational motion output of the motor to reciprocal motion. The piston pump is configured to pump paint when reciprocated by the pump drive while mounted on the support frame. The door blocks the pump assembly from being removed from the support frame via the mounting interface while in a closed position, and permits the pump assembly to be mounting to the support frame via engagement of the pair of cantilevered protrusions with the pair of mounting holes while the door is in an open position.

Example 3

A paint sprayer according to another exemplary embodiment of this disclosure includes, among other possible things, a support frame, a motor connected to the support frame, a pump assembly removably mounted on the support frame, a front cover connected to the support frame, a pump drive mounted on the support frame and located between the front cover and the support frame, a door attached to the front cover, an electrical connector, and a pressure control located on the pump assembly. The pump drive is configured to convert rotational motion output by the motor to reciprocal motion of a piston pump contained within the pump assembly. The piston pump is configured to pump paint when reciprocated by the pump drive while mounted on the support frame. The door is configured to linearly slide in a track of the front cover between an open position and a close position. The door slides in a first direction towards a closed position and slides in a second direction towards the open position. The door blocks the pump assembly from being removed from the support frame while in the closed position but permits the pump to be removed from the support frame while in the open position. The electrical connector is located, in separate interfacing parts, on each of the pump assembly and the door. The pressure control is configured to output a signal that is used to regulate operation of the motor. The signal is conducted through the electrical connector. Sliding of the door in the first direction completes an electrical connection that permits the signal to travel through the electrical connector. Sliding of the door in the second direction breaks the electrical connection to prevent the signal from traveling through the electrical connector.

Example 4

An assembly according to another exemplary embodiment of this disclosure includes, among other possible things, a component and a door. The component defines an opening and a track extending substantially parallel to an edge of the opening from a first end to a second end. The door slidably engages the track and is disposed within the opening in a locked position. A pivot axis extends through the door. The track restrains rotation of the door about the pivot axis in the locked position at the first end of the track, and at least a portion of the track allows rotation of the door about the pivot axis in an unlocked position.

The assembly of the preceding example can optionally include, additionally and/or alternatively, any one or more of the following features, configurations and/or additional components:

A further embodiment of the foregoing assembly, wherein the door can translate from the unlocked position to an open position by rotating the door about the pivot axis when the door is in the unlocked position and thereby providing access to an interior of the component.

A further embodiment of any of the foregoing assemblies, wherein the door can include a tab extending from the door that engages the component in the locked position and in which the engaged tab prevents translation of the door along the track from the first end to the second end.

A further embodiment of any of the foregoing assemblies, wherein the tab can be integrally attached to the door at an attachment end and has an engagement end opposite the attachment end that is unrestrained by the door.

A further embodiment of any of the foregoing assemblies, wherein the tab can include a lip that engages the component to restrain translation of the door along the track when the door is in the locked position.

A further embodiment of any of the foregoing assemblies, wherein the lip can be positioned between the engagement end and the attachment end of the tab.

A further embodiment of any of the foregoing assemblies, wherein deflecting the tab away from the component can disengage the lip from the component and thereby allows translation of the door along the track.

A further embodiment of any of the foregoing assemblies, wherein the tab can be disposed in a cutout of the door, the cutout having a first width that is greater than a second width of the tab and a first length that is less than a second length of the tab such that the tab protrudes beyond a side surface of the door.

A further embodiment of any of the foregoing assemblies, wherein the tab has a thickened portion at the attachment end of the tab where the tab is joined to the door.

A further embodiment of any of the foregoing assemblies, wherein the door has an exterior surface that faces away from the component, and wherein the tab curves away from the exterior surface of the door near the engagement end of the tab.

A further embodiment of any of the foregoing assemblies, wherein a back side of the tab faces towards the component and includes at least one rounded ridge extending in a widthwise direction of the tab at the engagement end.

A further embodiment of any of the foregoing assemblies, wherein the door can further include a trunnion extending along the pivot axis of the door that is received in the track.

A further embodiment of any of the foregoing assemblies, wherein the trunnion can have a cuboidal portion and a cylindrical portion adjacent to the cuboidal portion.

A further embodiment of any of the foregoing assemblies, wherein the track can include a channel that extends from the second end towards the first end.

A further embodiment of any of the foregoing assemblies, wherein the channel is adapted to receive the cylindrical portion of the trunnion.

A further embodiment of any of the foregoing assemblies, wherein the track can include a guiding surface adjacent to the channel and located between the channel and the opening.

A further embodiment of any of the foregoing assemblies, wherein the guiding surface can be adapted to abut the cuboidal portion of the trunnion and thereby restrains rotation of the door about the pivot axis when the door is in the locked position and when the door is located along the track between the locked position and the unlocked position.

A further embodiment of any of the foregoing assemblies, wherein the track can include a pivot bore at the second end of the track.

A further embodiment of any of the foregoing assemblies, wherein the pivot bore extends from the channel to the opening.

A further embodiment of any of the foregoing assemblies, wherein a diameter of the pivot bore surrounds the cuboidal portion of the trunnion when the door is in the unlocked and open positions.

A further embodiment of any of the foregoing assemblies, wherein the component can have a plate extending from an interior side of the component adjacent the second end of the track and spaced from the door.

A further embodiment of any of the foregoing assemblies, wherein the plate can have a protuberance protruding towards the opening that engages the door to prevent rotation of the door about the pivot axis in the open position.

A further embodiment of any of the foregoing assemblies, wherein the door can include a groove along a side face of the door that aligns and receives the protuberance when the door is in the open position.

A further embodiment of any of the foregoing assemblies, wherein the groove includes a contoured portion adapted to mate with a contour of the protuberance when the door is in the open position.

A further embodiment of any of the foregoing assemblies, wherein the component further defines a catch portion adjacent to the opening that engages a portion of the door in the locked position.

A further embodiment of any of the foregoing assemblies, wherein the door can include a latch portion protruding from a side surface of the door that engages the catch portion when the door is in the locked position and thereby restrains rotation of the door about the pivot axis.

A further embodiment of any of the foregoing assemblies, wherein a length of the catch portion is less than a distance the door translates along the track such that translating the door from the first end to the second end of the track disengages the latch portion from the door.

A further embodiment of any of the foregoing assemblies, wherein the door can include a rib extending substantially perpendicularly to the latch portion.

Example 5

A sprayer assembly according to another exemplary embodiment of this disclosure includes, among other possible things, a housing, a support frame connected to the housing, a plurality of protrusions extending from the support frame in a longitudinal direction, and a pump assembly having a plurality of mounts. Each protrusion includes a proximal end affixed to the support frame and a distal end cantilevered relative to the support frame. Each mount is adapted to engage one of the protrusions.

The sprayer assembly of the preceding example can optionally include, additionally and/or alternatively, any one or more of the following features, configurations and/or additional components:

A further embodiment of the foregoing sprayer assembly, wherein each protrusion can be substantially parallel to each of the other protrusions.

A further embodiment of any of the foregoing sprayer assemblies, wherein mating surfaces of the mounts and the protrusions can restrain the pump assembly against a pumping motion resulting from operation of the pump assembly.

A further embodiment of any of the foregoing sprayer assemblies, wherein the pump assembly can include a cylinder and a piston reciprocating within the cylinder along a pumping axis. At least two protrusions are spaced at a substantially equal distance from the pumping axis and engage mounts disposed on opposite ends of the pump assembly.

A further embodiment of any of the foregoing sprayer assemblies, wherein each protrusion can extend in a direction that is substantially perpendicular to a reciprocating direction of the piston.

A further embodiment of any of the foregoing sprayer assemblies, wherein each protrusion can be received in a bore of each mount.

A further embodiment of any of the foregoing sprayer assemblies, wherein each protrusion can be press-fit into a void formed by the support frame.

A further embodiment of any of the foregoing sprayer assemblies, wherein each protrusion can be a cylindrical pin affixed to the support frame.

A further embodiment of any of the foregoing sprayer assemblies, wherein each protrusion can be integrally formed with the support frame.

A further embodiment of any of the foregoing sprayer assemblies can further include a cover attached to the support frame and a door coupled to one of the cover and the pump assembly and positioned within an opening of the cover in a locked position.

A further embodiment of any of the foregoing sprayer assemblies, wherein the pump assembly can be removable independent of the support frame and the cover in an open position of the door, and wherein the door can restrain movement of the pump assembly relative to the support frame in the longitudinal direction in the locked position.

A further embodiment of any of the foregoing sprayer assemblies, wherein translating the pump assembly in the longitudinal direction and away from the support frame can remove the pump assembly from the housing without decoupling the door from the cover.

A further embodiment of any of the foregoing sprayer assemblies can further include a pump drive supported by the support frame.

A further embodiment of any of the foregoing sprayer assemblies, wherein the pump drive can include a pump coupler having a yoke, wherein the yoke has an open end facing away from the support frame and configured to engage a driving component of the pump assembly.

A further embodiment of any of the foregoing sprayer assemblies, wherein the yoke can be substantially U-shaped.

A further embodiment of any of the foregoing sprayer assemblies, wherein the sprayer assembly can include a motor with an output shaft, and wherein the pump drive can include a gear train, a carrier, and at least one rail. The gear train can include an input gear rotationally affixed to the output shaft, an output gear that is rotationally coupled to the input gear, and an eccentric shaft extending from the output gear that has an axis that is offset relative to a rotational axis of the output gear. The carrier can include an egg-shaped bore that engages the eccentric shaft. The at least one rail can extend in a direction that is substantially perpendicular to a major axis of the egg-shaped bore. The gear train is configured such that rotational motion of the output gear produces eccentric motion of the eccentric shaft which thereby drives the carrier in a reciprocating motion along the at least one rail. The pump coupler is affixed to the carrier such that the reciprocating motion of the carrier is transmitted to a piston of the pump assembly through the pump coupler.

Example 6

An assembly according to another exemplary embodiment of this disclosure includes, among other possible things, a door displaceable between a locked position and an unlocked position and an electrical connector. The electrical connector includes a first part affixed to the door and a second part configured to mate with the first part and restrained independently of the door. In the locked position of the door, the first and second parts of the electrical connector are coupled and thereby form an electrical connection. In the unlocked position of the door, the first and second parts are decoupled and thereby disconnect the electrical connection.

The assembly of the preceding example can optionally include, additionally and/or alternatively, any one or more of the following features, configurations and/or additional components:

A further embodiment of the foregoing assembly can include a housing cover defining a track. The track extends from a first end to a second end opposite the first end. The door is received in the track. Sliding the door along the track from the first end towards the second end disconnects the first and second parts of the electrical connector.

A further embodiment of any of the foregoing assemblies, wherein a door displacement can define a linear distance that the door translates from the locked position to the unlocked position.

A further embodiment of any of the foregoing assemblies, wherein an engagement length can define a distance that the first and second parts overlap when the door is in the locked position.

A further embodiment of any of the foregoing assemblies, wherein the engagement length can be at least half the door displacement to inhibit fouling of the electrical connector from corrosion and foreign debris.

A further embodiment of any of the foregoing assemblies, wherein the door can include a cable support spaced from the first part of the electrical connector and coupled to the door.

A further embodiment of any of the foregoing assemblies, wherein the cable support and the door can define a gap therebetween, and wherein a cable electrically connected to the first part can extend through the gap and is thereby supported by the cable support.

A further embodiment of any of the foregoing assemblies, wherein the cable support can be contoured to support the cable at a bend of the cable.

A further embodiment of any of the foregoing assemblies, wherein the door can further comprise an aperture extending through the door at the cable support and intersecting the gap.

A further embodiment of any of the foregoing assemblies, wherein the door con further include a pivot axis extending through the door.

A further embodiment of any of the foregoing assemblies, wherein the track can restrain rotation of the door about the pivot axis in the locked position at the first end of the track.

A further embodiment of any of the foregoing assemblies, wherein at least a portion of the track allows rotation of the door about the pivot axis in the unlocked position.

A further embodiment of any of the foregoing assemblies, wherein the cable support can be adjacent the pivot axis.

A further embodiment of any of the foregoing assemblies, wherein the second part can include a base and an electrical conductor protruding from the base.

A further embodiment of any of the foregoing assemblies, wherein the first part can include a body and a receptacle defined within the body and adapted to receive the electrical conductor.

A further embodiment of any of the foregoing assemblies, wherein the electrical connector can include an insulator affixed to one of the first part and the second part that encapsulates a portion of the electrical connector when the first and second parts are coupled.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A paint sprayer comprising: a support frame; a motor connected to the support frame, the motor is electric; a pump drive connected to the support frame and configured to covert rotational motion output by the motor to reciprocal motion; a cover connected to the support frame, wherein the pump drive is disposed between the cover and the support frame; a door attached to the cover or the support frame, wherein the door is positioned within an opening that extends through the cover, and wherein the door is moveable between a closed position and an open position; a pump assembly removably mounted on the support frame, the pump assembly comprising: a housing; a piston coupled to the pump drive and configured to reciprocate within the housing to pump paint;

an outlet; a pressure sensor positioned to sense a pressure produced by the piston; a prime control; a pressure control configured to output a signal that is used to regulate operation of the motor based on an output by the pressure sensor, the pressure control comprising a rotatable knob for user input of a pressure setting; and one or more insulated wires that run from the pressure control along the housing, wherein the pressure control transmits the signal through the one or more insulated wires; and a mounting interface comprising a pair of holes that respectively receive a pair of protrusions, the pair of mounting holes located on one of the support frame or the housing and the pair of protrusions located on the other of the support frame or the housing, the pair of mounting holes located on opposite sides of the piston at least when the pump assembly is mounted to the support frame; wherein the pump assembly is removeable through the opening, together with the housing, the piston, the pressure sensor, the prime control, the outlet, and the pressure control as a single assembly, from the support frame of the paint sprayer while the door is in the open position and the pump drive and the cover remain connected to the support frame by sliding the plurality of protrusions out from the plurality of holes.

2. The paint sprayer of claim 1, wherein the pair of mounting holes is formed by the housing and extends through the housing.

3. The paint sprayer of claim 2, wherein the pair of protrusions extend from a first side of the support frame opposite a second side, and wherein the motor connects to the second side of the support frame and extends from the second side of the support frame.

4. The paint sprayer of claim 3, wherein the pair of protrusions are parallel.

5. The paint sprayer of claim 4, wherein the pair of protrusions extend perpendicularly to a longitudinal dimension of the piston.

6. The paint sprayer of claim 1, wherein the pump assembly comprises a collar joined to the piston, and wherein the pump drive comprises a coupler that includes an open end facing outward away from the support frame, and wherein the open end of the coupler receives the collar.

7. The paint sprayer of claim 1, wherein the cover is removable, and wherein the pump drive is accessible with the cover removed.

8. The paint sprayer of claim 1, wherein the pump assembly is partially contained between the cover and the support frame when mounted on the support frame and protrudes out from the cover.

9. The paint sprayer of claim 1, further comprising an electrical connector electrically connecting the pressure control to the motor.

10. The paint sprayer of claim 9, wherein mounting the pump assembly onto the support frame electrically connects the pressure control to the motor at the electrical connector.

11. The paint sprayer of claim 9, wherein the electrical connector includes, in separate interfacing parts, a first part and a second part affixed to the pump assembly and configured to mate with the first part.

12. The paint sprayer of claim 11, wherein the first part includes a plurality of recesses adapted to receive a plurality of protrusions extending from the second part.

13. The paint sprayer of claim 12, wherein the first part overlaps the second part when the first part receives the second part to create an elongated seal.

14. The paint sprayer of claim 13, wherein disengagement of the first part from the second part disconnects an electrical connection between the pump assembly and the motor, and wherein engagement of the first part with the second part connects the electrical connection between the pump assembly and the motor.

15. The paint sprayer of claim 14, wherein the electrical connector includes an insulator affixed to one of the first part and the second part that encapsulates a portion of the electrical connector when the first and second parts are engaged.

16. The paint sprayer of claim 1, wherein engaging portions of the cover and the door guide movement of the door between the open position and the closed position, and wherein the door blocks the pump assembly from sliding the plurality of protrusions out from the plurality of holes while the door is in the closed position.

17. The paint sprayer of claim 16, wherein the door moves from the closed position to the open position by sequential linear slide then pivot motions, and the door moves from the open position to the closed position by sequential pivot then linear slide motions.

18. The paint sprayer of claim 1, further comprising:

a cable support protruding from an interior surface of the door, wherein the cable support is contoured and supports the one or more wires of the pump assembly with respect to the door.

* * * * *